US005115841A

United States Patent [19]

Horino et al.

[11] Patent Number: 5,115,841

[45] Date of Patent: May 26, 1992

[54] DRAUGHT BEER DISPENSING SYSTEM

[75] Inventors: Morikatsu Horino, Tokyo, Japan; Yoshiaki Yagi, both of Tokyo, Japan

[73] Assignee: Kirin Beer Kabushiki Kaisha, Tokyo, Japan

[21] Appl. No.: 641,620

[22] Filed: Jan. 16, 1991

Related U.S. Application Data

[60] Continuation of Ser. No. 395,899, Aug. 18, 1989, abandoned, which is a division of Ser. No. 234,894, Aug. 22, 1988, Pat. No. 4,864,396.

[30] Foreign Application Priority Data

| | | | |
|---|---|---|---|
| Aug. 24, 1987 | [JP] | Japan | 62-208250 |
| Aug. 24, 1987 | [JP] | Japan | 62-208251 |
| Jun. 30, 1988 | [JP] | Japan | 63-85698 |
| Jul. 15, 1988 | [JP] | Japan | 63-93081 |

[51] Int. Cl.[5] ..... B67D 1/04

[52] U.S. Cl. ..... 141/250; 141/46; 141/251; 141/263; 222/641

[58] Field of Search ..... 141/46, 47, 181, 182, 141/193, 250, 251, 263, 264, 266, 279, 284, 192, 231, 206; 222/641, 642

[56] References Cited

U.S. PATENT DOCUMENTS

| | | | |
|---|---|---|---|
| 581,700 | 5/1897 | Donally | 141/181 X |
| 784,596 | 3/1905 | Schlangen | 141/4 |
| 786,621 | 4/1905 | Beebe | 141/46 |
| 989,546 | 4/1911 | Jensen | 141/181 |
| 1,132,218 | 3/1915 | Schneider | 141/250 |
| 1,637,808 | 8/1927 | Armond et al. | 141/250 |
| 2,012,247 | 8/1935 | Muller | 141/47 |
| 2,113,887 | 4/1938 | Hutsell | 141/284 |
| 2,685,393 | 8/1954 | Thompson | 141/250 |
| 3,056,436 | 10/1962 | Fechhelmer et al. | 141/263 |
| 3,150,697 | 9/1964 | Risser | 141/206 X |
| 4,000,765 | 1/1977 | Lydiksen | 141/181 |
| 4,253,502 | 3/1981 | Guercio | 141/47 |
| 4,313,476 | 2/1982 | Bennett et al. | 141/181 X |
| 4,413,752 | 11/1983 | McMillan et al. | 222/56 |

*Primary Examiner*—Henry J. Recla
*Assistant Examiner*—Casey Jacyna
*Attorney, Agent, or Firm*—Ladas & Parry

[57] ABSTRACT

A draught beer dispensing system according to the present invention comprises a beer receiving receptacle, a beer dispensing valve from which the draught beer is dispensed into the receptacle under the pressure of carbon dioxide gases, a source supplying carbon dioxide gases, and a movable dispensing nozzle connected to the beer dispensing valve through a flexible pipe and operated by an actuating means. When draught beer is dispensed, the tip of the beer dispensing nozzle is positioned within the receptacle first and is moved upwardly to the upper edge of the receptacle upon completion of beer dispensing.

1 Claim, 25 Drawing Sheets

DRAUGHT BEER DISPENSING SYSTEM

CROSS REFERENCE

This application is a continuation application of U.S. application Ser. No. 07/395,899 filed on Aug. 18, 1989 now abandoned, which is in turn a divisional application of U.S. Ser. No. 234,894 filed on Aug. 22, 1988 and now granted and U.S. Pat. No. 4,864,396. Thus this application discloses and claims only the subject matter described in prior applications. This application is now also co-pending with U.S. application Ser. No. 395,805 and Ser. No. 396,568 which are divisions of U.S. Pat. No. 4,864,396 and filed respectively on Aug. 18, 1989 and Aug. 21, 1989.

BACKGROUND OF THE INVENTION

The present invention relates to a draught beer dispensing system, and more particularly to a draught beer dispensing system which, can, in dispensing draught beer under pressure, automatically control pressure of carbon dioxide gas to be supplied into a draught beer receiving receptacle to an optimum pressure depending upon temperature of the draught beer to thereby automatically dispense a predetermined quantity of draught beer.

As a system for dispensing barreled draught beer, a draught beer dispensing system has been heretofore known. In such a draught beer dispensing system, pressurized carbon dioxide gases are supplied from a carbon dioxide cylinder into a keg filled with draught beer, and the draught beer within the keg is cooled in a cooling tank by the pressure of the thus supplied carbon dioxide gases and then dispensed.

There is a constant equilibrium relationship between temperature and pressure of draught beer filled in the keg. Taking, as an example, the case of 0.50% (5.0 g/) which is a standard content of carbon dioxide gas of the barreled draught beer, beer in 0.50% of carbon dioxide content assumes a stable state under the pressure of 2 $kg/cm^2$ at 20° C. This stable state herein termed means the just balanced state in which the carbon dioxide gas is no longer dissolved into beer nor liberated from the beer. Pressure at that time is generally called the equilibrium pressure. That is, in order that the carbon dioxide gases within the barreled draught beer may be always dispensed in a stable state, the equilibrium pressure according to the temperature of the beer has to be applied, which is a proper pressure. Accordingly, flat beer or foamy beer brings forth unless pressure of carbon dioxide gas supplied into a keg is set to an equilibrium pressure corresponding to temperature of draught beer when the draught beer is pressurized and dispensed from the keg, and therefore, pressure of the carbon dioxide gas supplied into the keg has to be controlled on the basis of the beer temperature. That is, when the pressure of carbon dioxide gases supplied into the keg is low, the carbon dioxide gases within the draught beer are liberated to bring forth flat beer with less content of carbon dioxide gas, whereas when the pressure of carbon dioxide gases supplied into the keg is high, the carbon dioxide gases are dissolved into the draught beer to bring forth foamy beer with much content of carbon dioxide gas. For this reason, a method for automatically controlling gas pressure within a draught beer receiving receptacle as disclosed in Japanese Laid-Open Patent Publication No. 64,790/1987 has been proposed. According to this controlling method, there comprises a pressure regulating member composed of a plurality of pressure reducing valves provided in parallel with each other to regulate pressure of carbon dioxide gases supplied from a carbon dioxide cylinder into a draught beer receiving receptacle, a temperature detection member composed of a temperature sensor for detecting a temperature of draught beer within the receiving receptacle, and a control member, whereby when the detection member detects that the temperature of draught beer within the draught beer receiving receptacle is higher than a predetermined temperature, the pressure of the supplied carbon dioxide gas caused by the pressure regulating member is increased by the control of the control member which receives a detection signal, whereas when the detection member detects that the temperature of draught beer within the draught beer receiving receptacle is lower than a predetermined temperature, the pressure of the supplied carbon dioxide gas caused by the pressure regulating member is decreased.

Next, one example of a conventional draught beer dispensing system will be described with reference to FIG. 29.

In FIG. 29, the reference numeral 1 designates a dispenser, which has a cooling coil 3 within a cooling tank 2, and a heat exchange is effected within the cooling coil 3 so as to cool beer within the cooling coil 3. On the end of the outlet side of the cooling coil 3 is provided a beer dispensing valve 110 called a tap which is opened and closed manually.

A draught beer keg 5 constituting a draught beer receiving receptacle is installed adjacent to the dispenser 1, and a dispenser head 6 is detachably mounted on the lip portion of the draught beer keg 5. The dispenser head 6 has a siphon pipe 7 suspended within the keg and a carbon dioxide gas supplying pipe 8 in communication with an upper part within the keg, the siphon pipe 7 being in communication with an inlet side of the cooling coil 3 by means of a beer hose 9, the carbon dioxide gas supplying pipe 8 being in communication with a carbon dioxide gas cylinder 13 through a manual pressure reducing valve 12 by means of a carbon dioxide gas hose 10.

In the aforementioned draught beer dispensing system, in the case where the draught beer within the draught beer keg 5 is dispensed, the carbon dioxide gases within the carbon dioxide gas cylinder 13 are supplied into the draught beer keg 5 through the pressure reducing valve 12, the draught beer within the keg 5 is supplied to the cooling coil 3 of the dispenser 1 through the siphon pipe 7 by pressure of the thus supplied carbon dioxide gases, and the beer dispensing valve 10 is opened to thereby dispense draught beer.

Next, a conventional beer dispensing valve will be described with reference to FIGS. 31 and 32.

A beer dispensing valve 110 shown in FIG. 31 is a manual dispensing valve having a foaming function. The beer dispensing valve 110 comprises a valve body 111, a valve stem 112 slidably provided within the valve body 111 and a lever 113 for sliding the valve stem 112, the valve stem 112 having a valve 114 provided at the front end thereof, the valve 114 being engaged with and disengaged from a valve seat 111*a* of the valve body 111 to perform a valve action.

The valve 114 is composed of a packing retaining member 115 slidably fitted in the front end of the valve stem 112 and a packing 116 held by the packing retaining member 115, and a compression coil spring 118 is interposed between the packing retaining member 115 and a nut 117 threadedly mounted on the front end of the valve stem 112. The nut 117 is formed at the front end thereof with a beer introducing small hole 117*a*, and the valve stem 112 is also formed with a foaming hole 112*a*.

With this arrangement, in dispensing draught beer, when the lever 113 is pulled down in a direction as indicated by arrow, the valve stem 112 slidably moves in a direction as indicated by arrow and the packing 116 of the valve 114 is disengaged from the valve seat 111*a* with the result that draught beer is dispensed from a nozzle 111*n* as shown by arrow [FIG. 32(*a*)].

After a predetermined quantity of draught beer has been dispensed into a receptacle such as a mug, when the lever 113 is reversely pulled down as shown in FIG. 32(*b*), the valve stem 112 slidably moves in a direction as indicated by arrow, the packing 116 of the valve 114 becomes seated on the valve seat 111*a* to stop dispensing the draught beer, the packing retaining member 115 slidably moves against the biassing force of the compression coil spring 118 whereby the foaming hole 112*a* is opened with the result that the draught beer passes through the beer introducing small hole 117*a* and foaming hole 112*a* into a foam which is then dispensed from the nozzle 111*n* into a receptacle 45 such as a mug.

However, there is a constant equilibrium relationship between temperature and pressure of draught beer filled in the keg as previously mentioned. When this relationship is shown taking, as an example, the case of 0.50% which is a standard content of carbon dioxide gas of barreled draught beer, a temperature-pressure curve $P_L$ of beer shown in FIG. 30 is obtained. More specifically, when the draught beer temperature (°C.) and pressure (kg/cm$^2$) are taken on the axes of abscissa and ordinates, respectively, it is found that there is a regular (though non-linear) equilibrium relationship between temperature and pressure of draught beer. However, in the conventional control method disclosed in the aforementioned Japanese Patent Laid-Open Publication No. 64790/1987, a plurality of pressure reducing valves provided in parallel with each other are selectively opened when draught beer is dispensed, and pressure of carbon dioxide gases supplied into the keg is stepwisely changed on the basis of the temperature of draught beer. This will be described in detail by way of an embodiment. When the draught beer temperature is less than 22° C., pressure of carbon dioxide gases supplied into the keg is controlled to 1.75 kg/cm$^2$; when the draught beer temperature is at 22° C. to 29° C., pressure of the carbon dioxide gases is controlled to 2.5 kg/cm$^2$; and when the draught beer temperature is more than 29° C., pressure of the carbon dioxide gases is controlled to 3.2 kg/cm$^2$. When this control is shown, a three-stage step-like pressure controll line $C_L$ is obtained as shown in FIG. 30.

Therefore, in the conventional control method, a rough pressure control partly far apart from the temperature-pressure curve $P_L$ of beer is carried out, which gives rise to a problem in that the pressure of the supplied carbon dioxide gases cannot be set to the equilibrium pressure corresponding to the temperature of draught beer to make it difficult to eliminate flat beer and foamy beer. On the other hand, in order to effect pressure control corresponding to the temperature-pressure curve $P_L$ of beer in the conventional control method, it is necessary to increase the number of pressure reducing valves to increase the number of steps in the pressure control line $C_L$, to thereby allow the line $C_L$ to be coincident with the temperature-pressure curve $P_L$ of beer as much as possible. For this reason, the construction of system becomes complicated, and in addition, a number of valves have to be controlled, which therefore gives rise to a problem in that the control method becomes cumbersome.

On the other hand, in the conventional draught beer dispensing system shown in FIG. 29, the operation of the beer dispensing valve 110 is manually effected, and the opening and closing of the beer dispensing valve are manually effected. Therefore, this gives rise to a problem in that the constant amount of draught beer may not be uniformly dispensed into every receptacle such as a mug, such that some receptacles undergo excessive pouring or insufficient pouring. Therefore, predetermined quantity of beer cannot be always dispensed.

Furthermore, when draught beer is dispensed, both beer dispensing step and foaming step are carried out by manual operation of a lever of a beer dispensing valve. Therefore, an operator holds a receptacle 45 such as a mug or a paper cup by one hand and supports it at the nozzle 111*n*, and has to open and close a lever 113 of a tap by the other hand. Therefore, an operator cannot be moved away from a dispenser during dispensing draught beer into a receptacle, and since both hands are engaged, other works cannot be done simultaneously during that period of time.

SUMMARY OF THE INVENTION

The present invention has been accomplished in view of the aforementioned circumstances. It is the primary object of the present invention to provide a draught beer dispensing system which can, in dispensing draught beer under pressure, automatically control pressure of carbon dioxide gases to be supplied into a draught beer receiving receptacle on the basis of temperature of the draught beer to automatically dispense a fixed quantity of draught beer.

Another object of the present invention to provide a draught beer dispensing system in which a beer dispensing valve in a draught beer dispensing system comprises an automatic valve capable of being automatically opened and closed, which has a foaming function as well as a beer dispensing function and which can dispense beer and produce foam in a necessary and sufficient quantity.

Further, in the case where a beer dispensing valve in a draught beer dispensing system comprises an automatic valve capable of being automatically opened and closed, since a receptacle is removed after beer has been dispensed, the extreme end of a dispensing nozzle provided on the beer dispensing valve must be positioned above the upper edge of the receptacle. Therefore the distance between the extreme end of the nozzle and the bottom of the receptacle is longer than that of the case where a manual valve is used as a dispensing valve. As a result, when beer is dispensed, excessive foam is produced due to long distance between the extreme end of the nozzle and the receptacle bottom. There gives rise to a further problem in that when dispensing of beer is terminated, foam is remained within a dispensing nozzle. Accordingly, a further object of the present invention is to provide a draught beer dispensing system which uses an automatic valve as a beer dispensing valve, wherein excessive foam when draught beer is dispensed is prevented from being produced, foam resulting from the extension of a dispensing nozzle is prevented from being remained within a nozzle, and a nucleus of producing foam when beer is further dispensed can be removed.

For achieving the aforementioned objects, according to one aspect of the present invention, there is provided a draught beer dispensing system for passing draught beer within a draught beer receiving receptacle through a cooling tank under the pressure of carbon dioxide gases supplied from a source of supplying carbon dioxide gases to dispense the draught beer from a beer dispensing valve, the system comprising a pressure regulating valve for regulating pressure of carbon dioxide gases supplied from said source of supplying carbon dioxide gases to the draught beer receiving receptacle, a temperature detector provided adjacent to said receiving receptacle to detect a temperature of the draught beer within the receiving receptacle and an arithmetically control device for controlling said pressure regulating valve on the basis of the detected value of said temperature detector. The relationship between a predetermined temperature and pressure of beer is stored in the arithmetically control device, the detected value of said temperature detector is inputted into said arithmetically control device, supplied pressure of carbon dioxide gases supplied into the draught beer receiving receptacle is arithmetically operated on the basis of said relationship between the temperature and pressure of beer, and an output signal corresponding to the thus operated supplied pressure is outputted to said pressure regulating valve to control the pressure regulating valve.

In dispensing the draught beer from the draught beer receiving receptacle by the aforesaid means, the temperature of the draught beer within the receiving receptacle is detected by the temperature detector, the detected value is inputted to the arithmetically control device, the supplied pressure of carbon dioxide gases supplied into the draught beer receiving receptacle is arithmetically operated on the basis of the relationship between temperature and pressure of beer stored in advance in the arithmetically control device, and the output signal corresponding to the operated result is outputted to the pressure regulating valve to control the pressure regulating valve, whereby the carbon dioxide gases with pressure which is optimum for the temperature of the draught beer when dispensed can be supplied to the draught beer receiving receptacle, thereby eliminating the flat beer or foamy beer.

According to another aspect of the present invention, there is provided a draught beer dispensing system for passing draught beer within a draught beer receiving receptacle through a cooling tank under the pressure of carbon dioxide gases supplied from a source of supplying carbon dioxide gases to dispense the draught beer from a beer dispensing valve, the system comprising a pressure regulating valve for regulating pressure of carbon dioxide gases supplied from said source of supplying carbon dioxide gases to the draught beer receiving receptacle, a temperature detector provided adjacent to said receiving receptacle to detect a temperature of the draught beer within the receiving receptacle and an arithmetically control device for controlling said pressure regulating valve on the basis of the detected value of said temperature detector and controlling opening an closing of said beer dispensing valve. The relationship between a predetermined temperature and pressure of beer is stored in the arithmetically control device, the detected value of said temperature detector is inputted into said arithmetically control device, supplied pressure of carbon dioxide gases supplied into the draught beer receiving receptacle is arithmetically operated on the basis of said relationship between the temperature and pressure of beer and the open time of said beer dispensing valve is also arithmetically operated, an output signal corresponding to the thus operated supplied pressure is outputted to said pressure regulating valve to control the pressure regulating valve and said beer dispensing valve is controlled to be opened during said operated open time.

In dispensing the draught beer from the draught beer receiving receptacle by the aforesaid means, the temperature of the draught beer within the receiving receptacle is detected by the temperature detector, the detected value is inputted to the arithmetically control device, the supplied pressure of carbon dioxide gases supplied into the draught beer receiving receptacle is arithmetically operated on the basis of the relationship between temperature and pressure of beer stored in advance in the arithmetically control device, the output signal corresponding to the operated result is outputted to the pressure regulating valve to control the pressure regulating valve and the beer dispensing valve is controlled to be opened during said operated open time, whereby a fixed quantity of draught beer can be automatically dispensed.

According to still another aspect of the present invention, there is provided a draught beer dispensing system for passing draught beer within a draught beer receiving receptacle through a cooling tank under the pressure of carbon dioxide gases supplied from a source of supplying carbon dioxide gases to dispense the draught beer from a beer dispensing valve, wherein said beer dispensing valve comprises an automatic opening and closing valve provided in a pipeline of a beer dispensing pipe and a bypass valve provided in a pipeline of a bypass pipe branched from said beer dispensing pipe.

By the aforesaid means, liquid beer can be dispensed in a state wherein the automatic opening and closing valve provided in the beer dispensing pipe is opened, and beer foam can be dispensed in a state wherein said automatic opening and closing valve is closed and the bypass valve provided in the bypass pipe is opened.

According to still another aspect of the present invention, there is provided a draught beer dispensing system for passing draught beer within a draught beer receiving receptacle through a cooling tank under the pressure of carbon dioxide gases supplied from a source of supplying carbon dioxide gases to dispense the draught beer from a beer dispensing valve, wherein said beer dispensing valve comprises an automatic opening and closing valve capable of taking a fully open position, a partly open position and a fully closed position.

By the aforesaid means, liquid beer can be dispensed in a state wherein the beer dispensing valve is fully opened, and beer foam can be dispensed in a state wherein the valve is partly opened.

According to still another aspect of the present invention, there is provided a draught beer dispensing system for passing draught beer within a draught beer receiving receptacle through a cooling tank under the pressure of carbon dioxide gases supplied from a source of supplying carbon dioxide gases to dispense the draught beer from a beer dispensing valve, wherein the front end of a dispensing nozzle in communication with and connected to said beer dispensing vale or a receptacle placing table is made to be movable up and down so that the relative position between the front end of the dispensing nozzle and the receptacle is changed, whereby when draught beer is dispensed, the front end of said dispensing nozzle is positioned within the receptacle, whereas upon termination of dispensing, the front end of said dispensing nozzle is positioned above the upper edge of the receptacle.

By the aforesaid means, when the draught beer is dispensed, the front end of said dispensing nozzle is moved down or the receptacle placing table is moved up to position the dispensing nozzle within the receptacle, whereas upon termination of dispensing, the front end of said dispensing nozzle can be moved up or the receptacle placing table can be moved down to position the dispensing nozzle above the upper edge of the receptacle. Therefore, excessive foaming when draught beer is dispensed can be prevented.

According to still another aspect of the present invention, there is provided a draught beer dispensing system for passing draught beer within a draught beer receiving receptacle through a cooling tank under the pressure of carbon dioxide gases supplied from a source of supplying carbon dioxide gases to dispense the draught beer from a beer dispensing valve, wherein said beer dispensing valve comprises a 3-way valve having three ports one of which is connected to a source of supplying pressure gases, the other of which is connected to a dispensing nozzle, and upon completion of beer dispensing, a pressurized gas is discharged from one port of said 3-way valve into a dispensing nozzle in communication with and connected to the beer dispensing valve.

By the aforesaid means, the beer dispensing valve comprises a 3-way valve, and upon completion of beer dispensing, a pressurized gas can be discharged from one port of said 3-way valve into a dispensing nozzle in communication with and connected to the beer dispensing valve. Therefore, the residual beer such as foam within the dispensing nozzle can be discharged.

BRIEF DESCRIPTION OF THE DRAWINGS

FIG. 24(*a*) being a front view, FIG. 24(*b*) being an enlarged view of essential parts, FIG. 24(*c*) being an explanatory view of operation of a dispensing nozzle shown in FIG. 24(*a*);

DETAILED DESCRIPTION OF THE PREFERRED EMBODIMENTS

A first embodiment of a draught beer dispensing system according to the present invention will be described hereinafter with reference to FIGS. 1 to 3.

Figure 1:
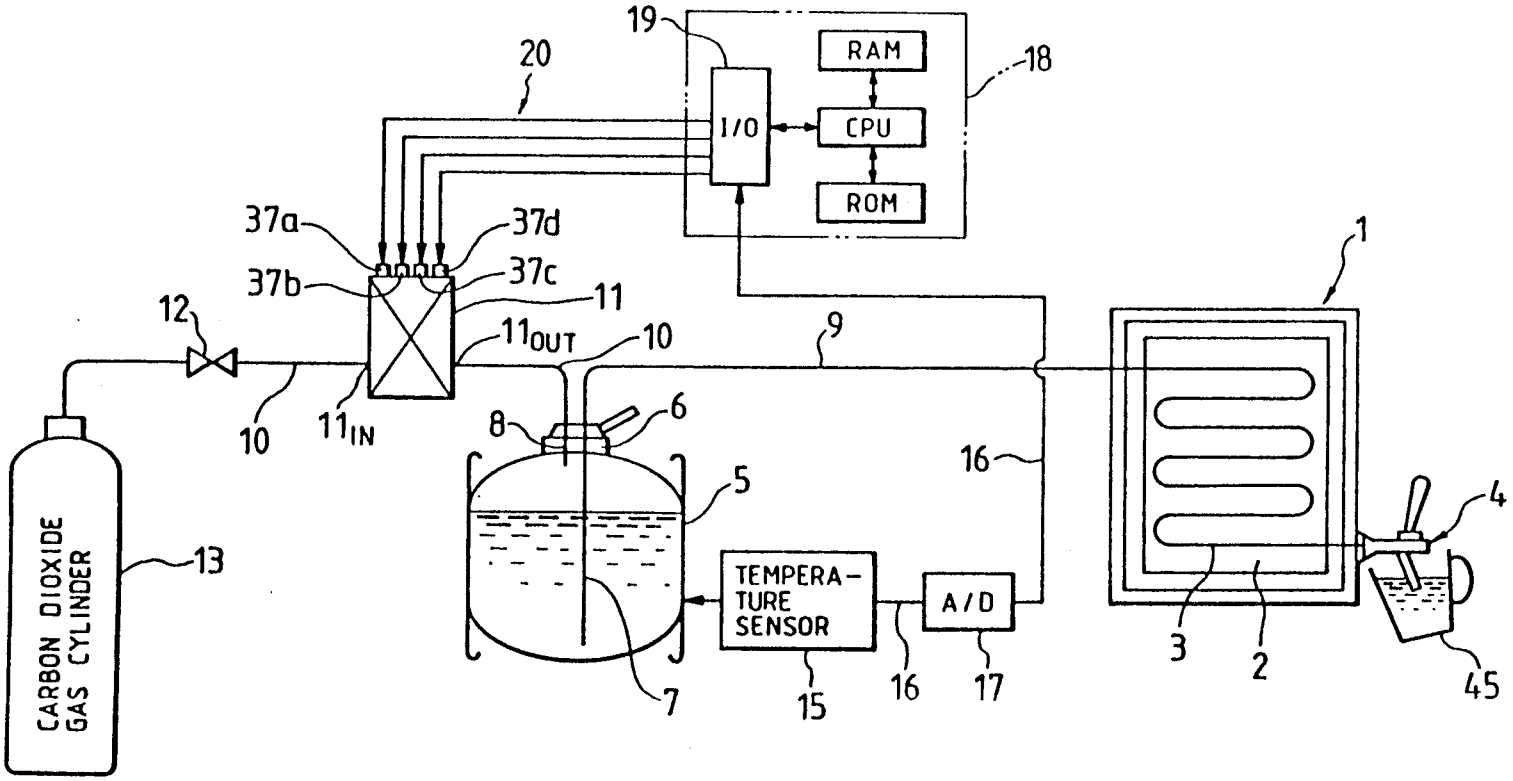
FIG. 1 is a basic structural view showing a first embodiment of a draught beer dispensing system according to the present invention.

FIG 1 is a basic structural view of a draught beer dispensing system according to the present invention. In FIG. 1, the reference numeral 1 designates a dispenser. The dispenser has a cooling coil 3 within a cooling tank 2, and a heat exchange is carried out in the cooling coil 3 so as to cool beer in the cooling coil 3. The dispenser 1 has a freezer (not shown) installed to cool a cooling medium (for example, water) within the cooling tank 2. A beer dispensing valve 4 is provided on the end of the outlet side of the cooling coil 3.

A draught beer keg 5 constituting a draught beer receiving receptacle is installed adjacent to the dispenser 1, and a dispenser head 6 is detachably mounted on a lip portion of the draught beer keg 5. The dispenser head 6 has a siphon pipe 7 suspended within the keg and a carbon dioxide gas supplying pipe 8 in communication with an upper part within the keg, the siphon pipe 7 being communicated and connected to an inlet side of the cooling coil 3 by a beer hose 9, the carbon dioxide gas supplying pipe 8 being communicated and connected to a secondary pressure outlet $11_{OUT}$ of an automatic pressure regulating valve 11 by a carbon dioxide gas hose 10.

A primary pressure inlet $11_{IN}$ of the automatic pressure regulating valve 11 is communicated with and connected to a carbon dioxide gas cylinder 13 through a manual pressure regulating valve 12 by the carbon dioxide gas hose 10.

A temperature sensor 15 comprising a thermistor or the like is detachably mounted on the lower outer side or bottom of the keg 5. A temperature of draught beer within the keg 5 is indirectly detected through an outer surface temperature of the keg by the temperature sensor 15 and is converted into an electric signal corresponding to the detected value. It is noted that the temperature sensor 15 may comprise, other than a thermistor, a temperature measuring resistor or a thermocouple. The temperature sensor 15 is connected to an I/O unit 19 of an arithmetically control device 18 through an A/D converter 17 by a cable 16.

The arithmetically control device 18 comprises a microcomputer, which is basically composed of CPU, RAM and ROM. A program for controlling CPU is written in ROM, and CPU performs an arithmetical operation while introducing external data required by the I/O unit 19 in accordance with the program or transferring data between CPU and RAM, and CPU outputs data processed as needed to the I/O unit 19.

The I/O unit 19 is connected to four electromagnetic valves 37*a* to 37*d* of the automatic pressure regulating valve 11 by cables 20.

In case of dispensing draught beer, pressure regulation of a multistage of the order of 15 stages may practically obtain an effect similar to stepless pressure regulation, and therefore the case where an automatic pressure regulating valve capable of performing pressure regulation of 15 stages will be described hereinafter.

Figure 2:
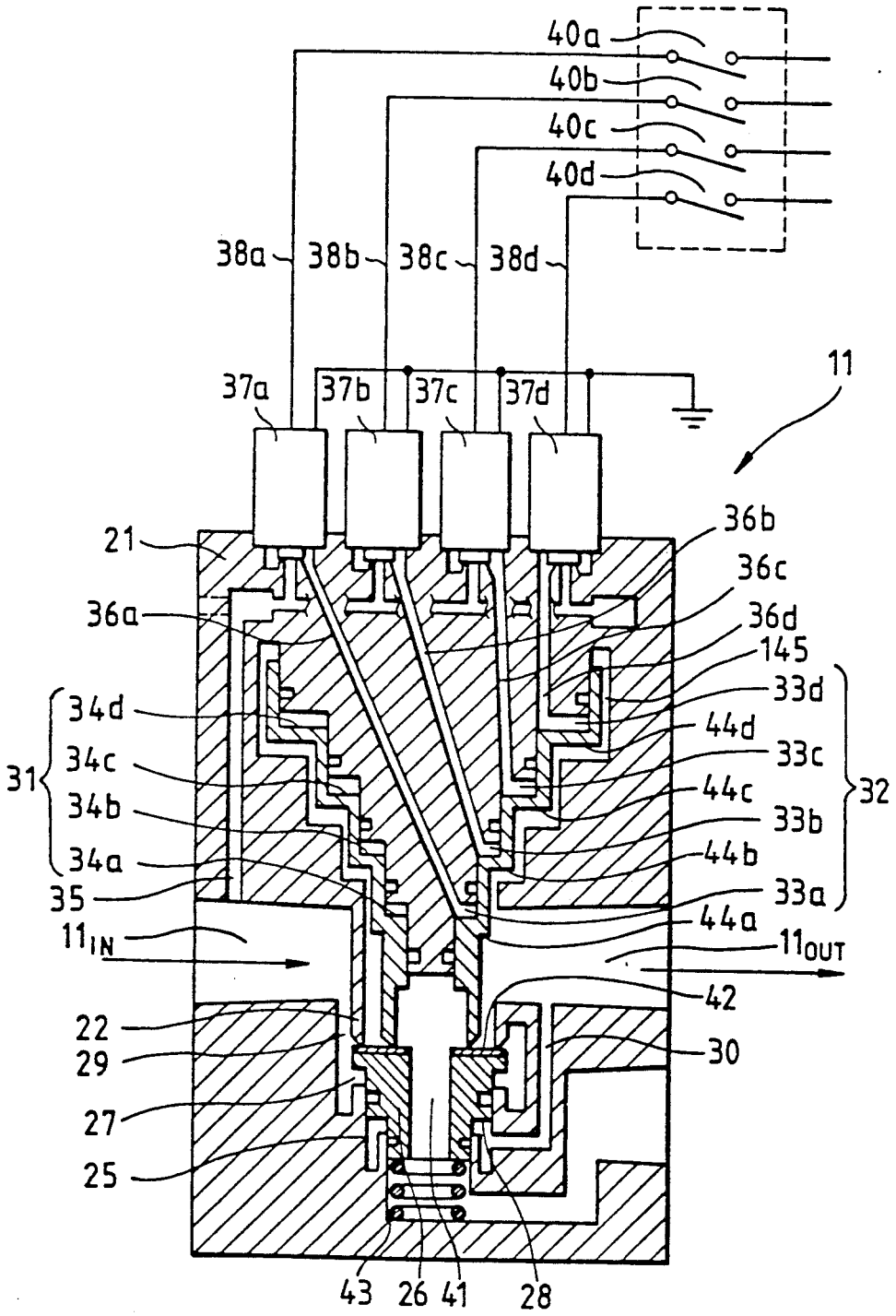
FIG. 2 is a sectional view of an automatic pressure regulating valve in the draught beer dispensing system.

In FIG. 2, the automatic pressure regulating valve 11 has a valve body 21 with a valve seat 22 located inside, with a primary pressure inlet $11_{IN}$ on the left side and a secondary pressure outlet $11_{OUT}$ on the right side.

In a main valve guide 25 downwardly of the valve seat 22 is disposed a piston type main valve 26 which is urged by means of a spring 43 against the valve seat 22 and slidably moved up and down. The main valve 26 is formed in threestages, and pressure receiving surfaces 27 and 28 in the respective stages are communicated with the primary pressure inlet $11_{IN}$ and secondary pressure outlet $11_{OUT}$ by passages 29 and 30, respectively, so that a primary pressure of the primary pressure inlet $11_{IN}$ is applied to the pressure receiving surface 27 of the upper first stage and a secondary pressure of the secondary pressure outlet $11_{OUT}$ is applied to the pressure receiving surface 28 of the middle second stage.

On the other hand, within the valve body 21 upwardly of the main valve 26 is provided a stepwise regulating valve 31 which is disposed slidably up and down in a manner capable of being engaged with or disengaged from an upper part of the main valve 26. That is, the valve body 21 is formed with a four-stage stepwise sliding guide 32, as a result, four-stage pressure areas 33*a*, 33*b*, 33*c* and 33*d* are formed. The regulating valve 31 which is in contact with the four-stage sliding guide 32 and moved up and down while being guided by the guide 32 has inner and outer four-stage pressure receiving surfaces 34*a*, 34*b*, 34*c* and 34*d*, and 44*a*, 44*b*, 44*c* and 44*d*. In this example, areas of pressure receiving surfaces sequentially increase twice as large in a manner such that let S be the pressure receiving area of the inner first-stage pressure receiving surface 34*a*, the pressure receiving area of the inner second-stage pressure receiving surface 34*b* immediately above the surface 34*a* is 2S. The same rule will be applied with respect to the surfaces 34*c* (becomes 4S) and 34*d* (becomes 8S).

The outer four-stage pressure receiving surfaces 44*a* to 44*d* of the regulating valve 31 are designed so that the secondary pressure is guided by the secondary pressure outlet $11_{OUT}$. the other hand, the valve body 21 is formed with a primary pressure introducing path 35 within the primary pressure inlet $11_{IN}$. Four pilot air passages 36*a*, 36*b*, 36*c* and 36*d* are branched from the primary pressure introducing path 35, the pilot air passages being communicated with the pressure areas 33*a*, 33*b*, 33*c* and 33*d*, respectively, and small electromagnetic valves 37*a*, 37*b*, 37*c* and 37*d* are disposed on the branched pilot air passages 36*a* to 36*d*, respectively. When signal voltages are inputted through solenoid signal voltage input lines 38*a*, 38*b*, 33*c* and 38*d*, respectively, the small electromagnetic valves 37*a* o 37*d* are operated to be closed and then opened. The signal voltages are sequentially selected in response to demand of adjustment by the arithmetically control device 18 and sent.

The main valve 26 is formed at the center with an exhaust opening 41. The reference numeral 42 denotes a pressure receiving surface receiving a secondary pressure at the upper part of the main valve 26.

A series of operations will be described in connection with the above-described construction.

First, when a group of relay contacts 40*a* to 40*d* subjected to ON-OFF control by the arithmetically control device 18 are respectively opened, the electromagnetic valves 37*a* to 37*d* remain closed since no sollenoid signal is applied thereto, and therefore, all of the pilot air passages 36*a* to 36*d* are closed. At that time, the main valve 26 is urged toward the valve seat 22 by the spring 43 to cutoff the passage.

When, from this state, the relay contact 40*a* is closed by the output signal of the arithmetically control device 18, the voltage is applied to the electromagnetic valve 37*a* through the solenoid signal voltage input line 38*a* to turn the electromagnetic valve 37*a* ON. Then, the pilot air passage 36*a* is opened so that the primary pressure is introduced from the primary pressure inlet $11_{IN}$ into the first stage pressure area 33*a*, and the primary pressure is applied to the inner first stage pressure receiving surface 34*a* of the regulating valve 31. Accordingly, thrusting force in downward direction according to the pressure receiving surface 34*a* is generated, and the entire regulating valve 31 is downwardly slidably moved to disengage the main valve 26 from the valve seat 22 to open it. Thereby, the secondary pressure within the secondary pressure outlet $11_{OUT}$ is applied to the whole surface of the outer four-stage divisional pressure receiving surfaces 44*a* to 44*d* of the regulating valve 31 to generate an upward thrusting force by which the regulating valve 31 is caused to be slidably moved upward.

Accordingly, the regulating valve 31 is slidably displaced until the previously selected downward thrusting force is balanced with the upward thrusting force. At the balanced position, the opening degree of the main valve 26 is fixed, and the adjusted secondary pressure is obtained upon fixing the opening degree within the secondary pressure outlet $11_{OUT}$. In this case, the opening degree of the main valve 26 is small since the downward thrusting force of the regulating valve generated by the first stage pressure receiving surface 34*a* is small. Therefore, the upward thrusting force balanced therewith is also small, and the adjusted secondary pressure is also small.

In the above described embodiment, in the case where the relay contact 40*b* is closed, the primary pressure is applied to the second stage pressure receiving surface 34*b* of the regulating valve 31 in which case the second stage pressure receiving surface 34*b* is set to a pressure receiving surface twice as large as the first stage pressure receiving surface 34*a*, and therefore the secondary pressure twice as large as the previous example, for instance.

Likewise, in the case where both relay contacts 40*a* and 40*b* are closed, the primary pressure is applied to both the first and second stage pressure receiving surfaces 34*a* and 34*b* of the regulating valve 31, thus obtaining the secondary pressure corresponding to the downward thrusting force.

The primary pressure is divided into 15 stages depending upon a combination of switching operations of these electromagnetic valves, which can be obtained as the secondary pressure, which will be shown in the following table.

| Electromagnetic valve input | | | | Divisional rate of | Secondary pressure (primary pressure |
|---|---|---|---|---|---|
| 37d | 37c | 37b | 37a | primary pressure | 4 kg/cm$^2$) |
| 0 | 0 | 0 | 0 | 0 | 0 |
| 0 | 0 | 0 | 1 | 1/15 | 0.27 |
| 0 | 0 | 1 | 0 | 2/15 | 0.53 |
| 0 | 0 | 1 | 1 | 3/15 | 0.80 |
| 0 | 1 | 0 | 0 | 4/15 | 1.07 |
| 0 | 1 | 0 | 1 | 5/15 | 1.33 |
| 0 | 1 | 1 | 0 | 6/15 | 1.60 |
| 0 | 1 | 1 | 1 | 7/15 | 1.86 |
| 1 | 0 | 0 | 0 | 8/15 | 2.13 |
| 1 | 0 | 0 | 1 | 9/15 | 2.39 |
| 1 | 0 | 1 | 0 | 10/15 | 2.66 |
| 1 | 0 | 1 | 1 | 11/15 | 2.93 |
| 1 | 1 | 0 | 0 | 12/15 | 3.19 |
| 1 | 1 | 0 | 1 | 13/15 | 3.46 |
| 1 | 1 | 1 | 0 | 14/15 | 3.73 |
| 1 | 1 | 1 | 1 | 15/15 | 4.00 |

wherein.
0 = voltage - ON
1 = voltage - OFF

In FIG. 1, the manual pressure reducing valve 12 is set so that carbon dioxide gases of primary pressure 50 kg/cm$^2$ filled in the carbon dioxide gas cylinder 13 is reduced to 4 kg/cm$^2$.

Next, the operation of the first embodiment of the draught beer dispensing system according to the present invention constructed as previously mentioned will be described.

In dispensing the draught beer from the draught beer keg 5, the relationship between the beer temperature and pressure (the aforesaid beer temperature-pressure curve $P_L$) is first stored in advance in ROM of the arithmetically control device 18. Then, the temperature of the draught beer is detected by the temperature sensor 15 mounted on the draught beer keg 5, and the detected value is converted into an electric signal which is inputted into the I/O unit 19 of the arithmetically control device 18. Then, CPU of the arithmetically control device 18 arithmetically operates a supplied pressure of carbon dioxide gas supplied into the keg 5 from the carbon dioxide gas cylinder 13 on the basis of the relationship between the beer temperature and pressure stored in advance in ROM from the aforesaid temperature detected value. An output signal corresponding to the thus operated result is outputted from the I/O unit 19 to the automatic pressure regulating valve 11 to control the pressure regulating valve 11. The carbon dioxide gases (the primary pressure—50 kg/cm$^2$) within the carbon dioxide gas cylinder 13 are reduced to 4 kg/cm$^2$ by the pressure reducing valve 12. And then the carbon dioxide gases are supplied to the automatic pressure regulating valve 11 through the carbon dioxide gas hose 10. In the automatic pressure regulating valve 11, the gases are reduced to 0.27 kg/cm$^2$ to 4 kg/cm$^2$ of pressure corresponding to the temperature of the draught beer within the draught beer keg 5 and supplied from the carbon dioxide gas hose 10 into the draught beer keg 5 via the carbon dioxide gas supply pipe 8 of the dispenser head 6. The draught beer within the keg 5 is supplied under the pressure of the thus supplied carbon dioxide gases to the cooling coil 3 of the dispenser 1 through the siphon pipe 7 and the beer hose 9, and in the cooling coil 3 the beer is instantaneously cooled and dispensed from the beer dispensing valve 4 into the receptacle 45.

In the automatic pressure regulating valve 11, the carbon dioxide gases of primary pressure of 4 kg/cm$^2$ are reduced to 15 stages in the range of the secondary pressure 0.27 kg/cm$^2$ to 4 kg/cm$^2$. The relationship between the temperature of draught beer and pressure having been reduced and controlled by the automatic pressure regulating valve 11 is shown in the following table.

| Temperature (C.) | Control Pressure (kg/cm$^2$) |
|---|---|
| 1.0 or less | 0.53 |
| 1.0 to 4.5 | 0.80 |
| 4.5 to 8.0 | 1.07 |
| 8.0 to 12.5 | 1.33 |
| 12.5 to 16.5 | 1.60 |
| 16.5 to 19.0 | 1.86 |
| 19.0 to 21.3 | 2.13 |
| 21.3 to 25 | 2.39 |
| 25.0 to 27.3 | 2.66 |
| 27.3 to 29.5 | 2.93 |
| 29.5 to 31.8 | 3.19 |
| 31.8 to 34.2 | 3.46 |
| 34.2 to 36.3 | 3.73 |
| not less than 36.3 | 4.00 |

Figure 3:
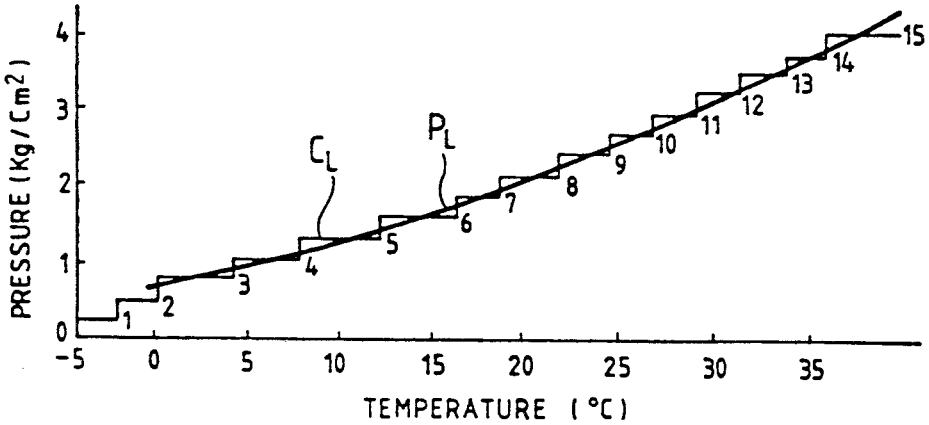
FIG. 3 is a view showing the relationship between the beer temperature and pressure according to the present invention.

FIG. 3 shows the pressure control line $C_L$ showing the relationship between the beer temperature and control pressure in the above table and the beer temperature-pressure curve $P_L$.

As will be apparent from FIG. 3, according to the present embodiment, the pressure control line $C_L$ is made approximately corresponding to the beer temperature-pressure curve $P_L$ whereby the pressure of carbon dioxide gases supplied to the draught beer keg 5 when draught beer is dispensed can be set to the pressure corresponding to the temperature of draught beer. The content of carbon dioxide gases within the draught beer can be maintained approximately constant, and the flat beer or foamy beer can be eliminated.

While in the above embodiment, a description has been made with respect to a single automatic pressure regulating valve capable of regulating pressure in 15 stages in order to simplify the construction of the system, it is be noted that this pressure regulating valve may comprise an electric pressure regulating valve or the like. In the case where the electric pressure regulating valve is used, stepless pressure regulation can be made.

As will be apparent from the above description of the embodiment, according to the present invention, in dispensing the draught beer from the draught beer receiving receptacle, the temperature of the draught been within the receiving receptacle is detected by the temperature detector, the detected value is inputted into the arithmetically control device, the supplied pressure of carbon dioxide gases supplied to the draught beer receiving receptacle is arithmetically operated on the basis of the relationship between the beer temperature and pressure stored in advance in the arithmetically control device and the output signal corresponding to the thus operated result is outputted to the pressure regulating valve to control the latter whereby the carbon dioxide gases which is optimum for the temperature of draught been when dispensed can be supplied to the draught beer receiving receptacle, the content of carbon dioxide gases of the draught beer can be maintained approximately constant, and the flat beer or foamy beer can be completely eliminated to always dispense draught beer of good quality.

Further, according to the present invention, since pressure of carbon dioxide gases supplied to the receiving receptacle can be regulated by the single pressure regulating valve, a system which is simple in construction and easy in pressure control can be provided.

Next, a second embodiment of a draught beer dispensing system according to the present invention will be described with reference to FIGS. 4 to 7.

Figure 4:
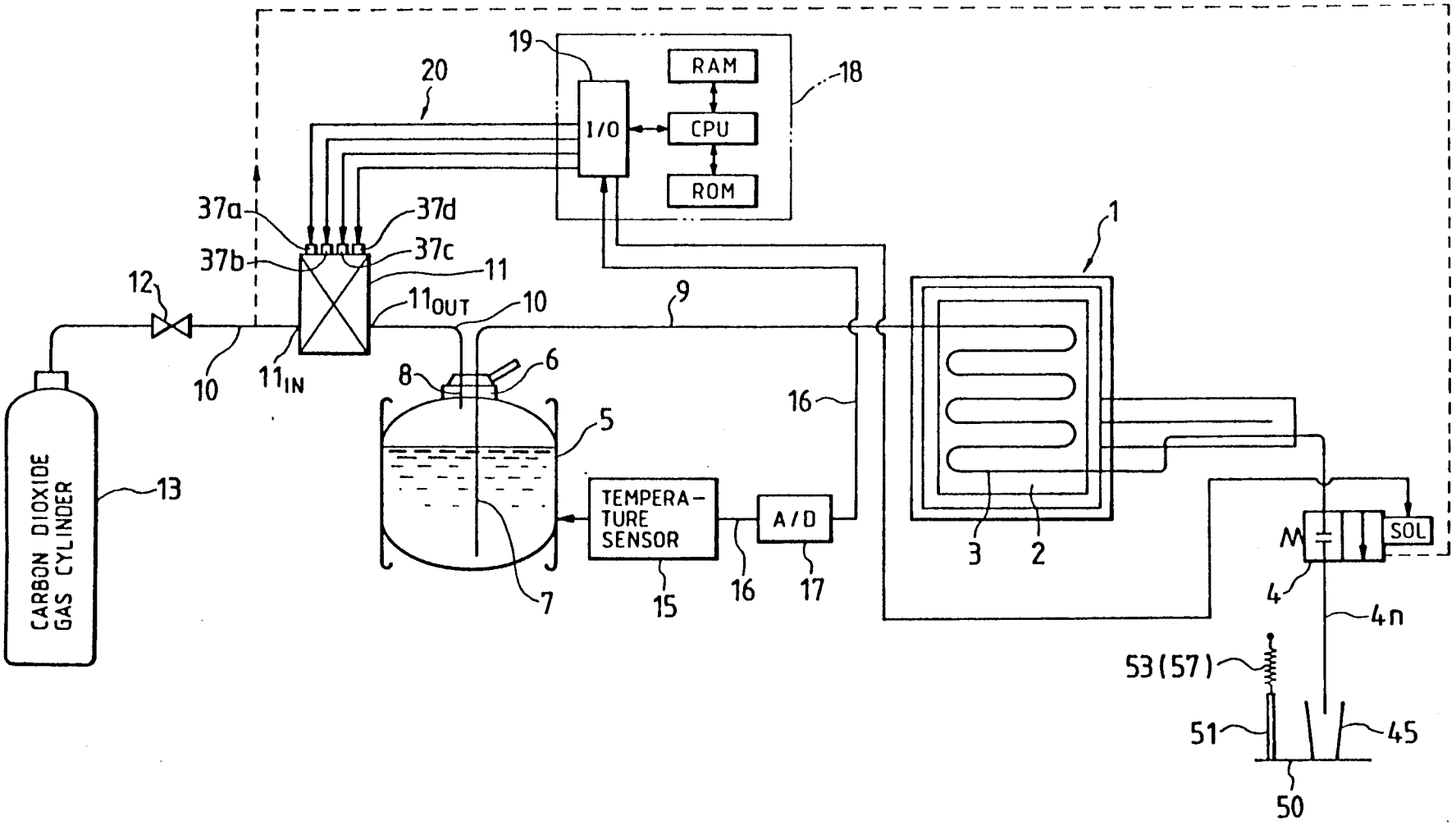
FIG. 4 is a basic structural view showing a second embodiment of a draught beer dispensing system according to the present invention.

FIG. 4 is a basic structural view of a draught beer dispensing system. In FIG. 4, the reference numeral 1 designates a dispenser. The dispenser 1 has a cooling coil 3 within a cooling tank 2, and a heat exchange is carried out in the cooling coil 3 so as to cool beer in the cooling coil 3. A beer dispensing valve 4 is provided on the end of the outlet side of the cooling coil 3. This beer dispensing valve 4 comprises a ball valve with an automatic electromagnetic valve. The electromagnetic valve is actuated by receiving an output signal from an I/O unit 19, and the valve 4 is actuated by carbon dioxide gases supplied from the secondary side of a manual pressure reducing valve 12.

A draught beer keg 5 constituting a draught beer receiving receptacle is installed adjacent to the dispenser 1, and a dispenser head 6 is detachably mounted on a lip portion of the draught beer keg 5. The dispenser head 6 has a siphon pipe 7 suspended within the keg and a carbon dioxide gas supplying pipe 8 in communication with an upper part within the keg, the siphon pipe 7 being communicated with and connected to an inlet side of the cooling coil 3 by a beer hose 9, the carbon dioxide gas supplying pipe 8 being communicated with and connected to a secondary pressure outlet $\mathbf{11}_{OUT}$ of an automatic pressure regulating valve 11 by a carbon dioxide gas hose 10.

A primary pressure inlet $\mathbf{11}_{IN}$ of the automatic pressure regulating valve 11 is communicated with and connected to a carbon dioxide gas cylinder 13 through a manual pressure regulating valve 12 by the carbon dioxide gas hose 10.

A temperature sensor 15 comprising a thermistor or the like is detachably mounted on the lower outer side or bottom of the keg 5. A temperature of draught beer within the keg 5 is indirectly detected through a outer surface temperature of the keg by the temperature sensor 15 and is converted into an electric signal corresponding to the detected value.

Figure 5:
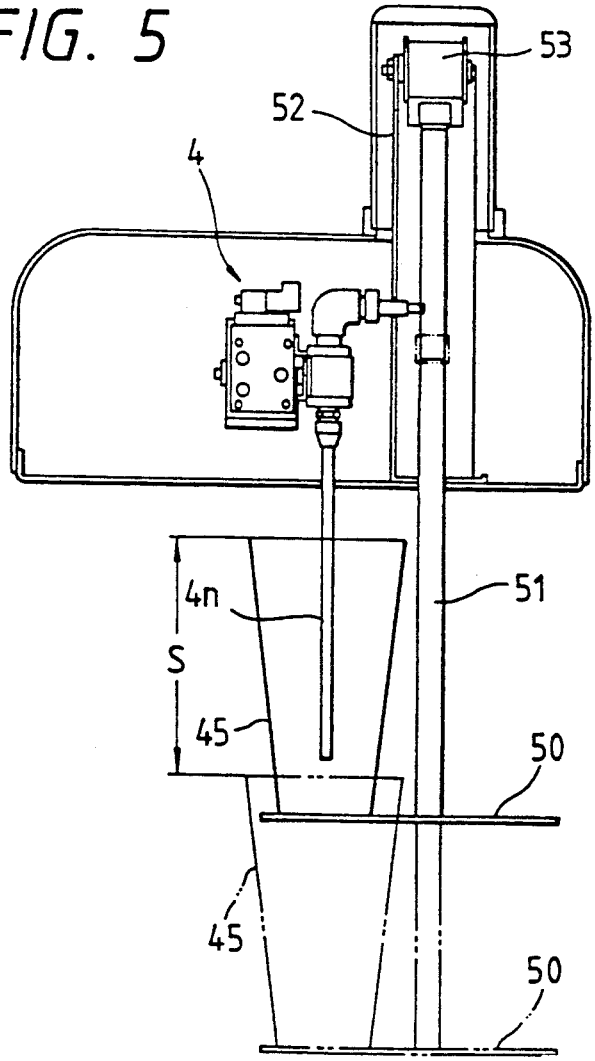
FIG. 5 is a sideview showing a table elevating mechanism of the draught beer dispensing system.
Figure 6:
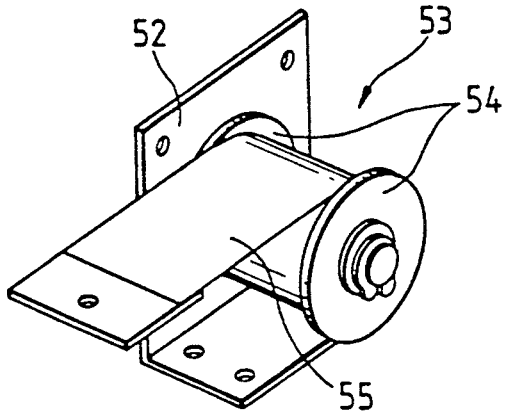
FIG. 6 is a perspective view of a constant load spring of the elevating mechanism.

Next, an elevating mechanism for a table 50 for placing a dispensing receptacle provided on the dispenser 1 will be described with reference to FIGS. 5 and 6.

The table 50 provided on the dispenser 1 is provided with shaft 51 an upper end of which is connected to constant load spring 53 constituting an elevating mechanism secured a frame 52. The constant load spring 53 comprises a web-like plate spring 55 wound around a drum 54 supported on the frame 52 as shown in FIG. 6, the constant load spring 53 being set so that at a load less than a predetermined level, the spring is not displaced but at a predetermined load, the spring is displaced and extended through a predetermined amount. It is set in this example so that when a fixed quantity of draught beer is dispensed into a receptacle 45 placed on the table 50, the constant load spring 53 is displaced and extended through a stroke S. That is, as shown in FIG. 5, the constant load spring 53 is in a non-displaced state before the draught beer is dispensed into the receptacle 45, and the table 50 is in an up position and the tip of a nozzle 4*n* of the beer dispensing valve 4 is positioned within the receptacle 45 so that foaming of beer can be suppressed to a suitable extent. When the draught beer dispensing valve 4 is opened and a fixed quantity of draught beer is dispensed into the receptacle 45, the constant load spring 53 is displaced and the table 50 is moved down to a position as indicated by the phantom line of FIG. 5. Then the tip of the nozzle 4*n* is brought into a position above the upper edge of the receptacle, and the receptacle 45 can be removed from the table 50.

Figure 7:
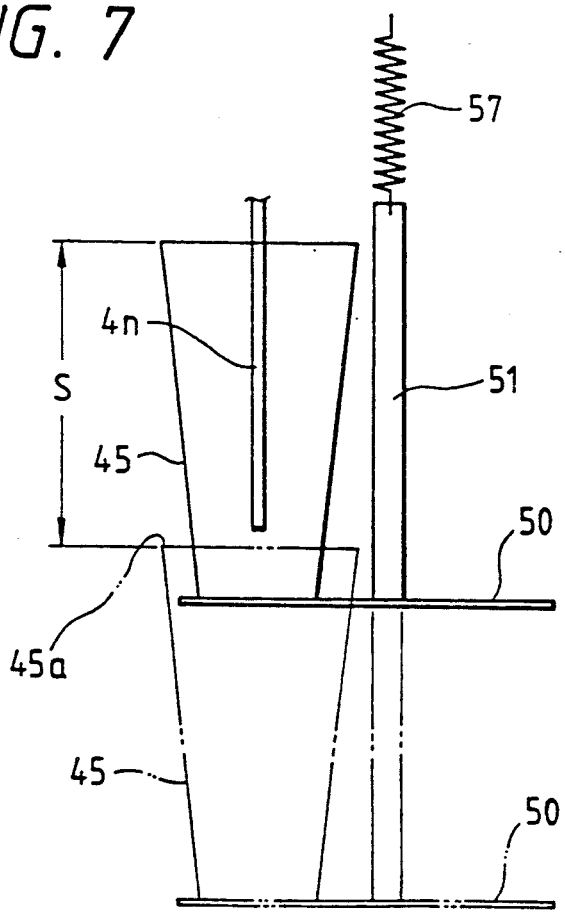
FIG. 7 is a side view showing a modified form of the elevating mechanism.

In place of the constant load spring 53, a tension coil spring 57 in which a load and a displacement is in a linear relationship may be used as shown in FIG. 7. In this case, before the draught beer is dispensed into the receptacle 45, the table 50 is in an up position and the tip of the nozzle 4*n* of the beer dispensing valve 4 is positioned within the receptacle 45. As dispensing of draught beer into the receptacle 45 progresses, the tension coil spring 57 is extended and the table is gradually moved down. When a fixed quantity of draught beer is dispensed into the receptacle 45, the table 50 is moved down to the lowermost position, and the tip of the nozzle 4*n* is brought into a position above the upper edge of the receptacle 45.

Next, the operation of the second embodiment of the draught beer dispensing system according to the present invention constructed as mentioned above will be described.

In dispensing draught beer from the draught beer keg 5, the equilibrium relationship between the beer temperature and pressure is first stored in advance in ROM of the arithmetically control device 18.

Between the supplied pressure P of carbon dioxide gases supplied to the draught beer keg 5 and the flow velocity V of draught beer dispensed from the dispenser, the following formula is established.

$$\frac{P}{\gamma} = \left(1 + \lambda \frac{l}{d}\right)\frac{V^2}{2g}$$

wherein $\gamma$ represents the unit volume weight of draught beer, d the inner diameter of a dispensing pipe, $\lambda$ the frictional factor for tube, l length from the keg to the tap, and g the gravity acceleration.

Accordingly, if the supplied pressure P is determined, the flow velocity V of the draught beer is determined by the above formula, and as a result, the dispensing flow rate Q dispensed from the dispenser is determined. Therefore, the relationship between the supplied pressure P and the dispensing flow rate Q is likewise stored in advance in ROM of the arithmetically control device 18.

Subsequently, the temperature of the draught beer is detected by the temperature sensor 15 mounted on the draught beer keg 5, and the detected value thereof is converted into an electric signal, which is inputted into I/O unit 19 of the arithmetically control device 18. Then, CPU of the arithmetically control device 18 arithmetically operates the supplied pressure P of carbon dioxide gases supplied into the keg 5 from the carbon dioxide gas cylinder 13 on the basis of the relationship between the beer temperature and pressure stored in advance in ROM from the above described temperature detected value, and arithmetically operates the open time of the beer dispensing value 4.

The open time T of the beer dispensing valve 4 can be arithmetically operated by T=M/Q, wherein M represents the dispensing quantity into the receptacle. Then, the output signal corresponding to the thus operated result is outputed from the I/Q unit 19 to the automatic pressure regulating valve 11 to control the latter, and the beer dispensing valve 4 is controlled to be opened during the aforesaid operated open time. The carbon dioxide gases (the primary pressure—50 kg/cm$^2$) within the carbon dioxide gas cylinder 13 are reduced to 4 kg/cm$^2$ by the pressure reducing valve 12. And then the carbon dioxide gases are supplied to the automatic pressure regulating valve 11 through the carbon dioxide gas hose 10. In the automatic pressure regulating valve 11, the gases are reduced to 0.27 kg/cm$^2$ to 4 kg/cm$^2$ of pressure corresponding to the temperature of the draught beer within the draught beer keg 5 and supplied from the carbon dioxide gas hose 10 into the draught beer keg 5 via the carbon dioxide gas supply pipe 8 of the dispenser head 6. The draught beer within the keg 5 is supplied under the pressure of the thus supplied carbon dioxide gases to the cooling coil 3 of the dispenser 1 through the siphon pipe 7 and the beer hose 9, and in the cooling coil 3 the beer is instantaneously cooled and dispensed into the receptacle 45 placed on the table 50 at an elevated position from the beer dispensing valve 4. The beer dispensing valve 4 is closed at the same time when a fixed quantity of draught beer is dispensed into the receptacle.

In the present embodiment, a ball valve is used as a beer dispensing valve in order not to impart bending resistance or drawing which adversely affects on the beer to be dispensed. The carbon dioxide gases are used as operating fluids for operating the beer dispensing valve in order to omit separate preparation of a source of compressed air.

According to the present invention, the pressure of carbon dioxide gases supplied to the draught beer keg 5 when draught beer is dispensed can be set to the pressure corresponding to the temperature of the draught beer to make the carbon dioxide gas pressure in the keg 5 a proper value. Furthermore, when the pressure of carbon dioxide gases in the keg 5 is determined, the flow velocity of draught beer is determined, and therefore the open time of the beer dispensing valve 4 required to dispense a fixed quantity of draught beer can be accurately arithmetically operated and set.

According to the present invention, the supplied pressure of carbon dioxide gases supplied into the draught beer receiving receptacle is arithmetically operated by the arithmetically control device, and the output signal corresponding to the thus operated result is outputted to the pressure regulating valve to control the latter and the open time of the beer dispensing valve is arithmetically operated on the basis of the supplied pressure of the carbon dioxide gases and the beer dispensing valve can be controlled to be opened during the thus operated open time. Therefore, a fixed quantity of draught beer can be always automatically dispensed. During the dispensing the operator can do other works.

Next, a third embodiment of a draught beer dispensing system according to the present invention will be described hereinafter with reference to FIGS. 8 to 10.

Figure 8:
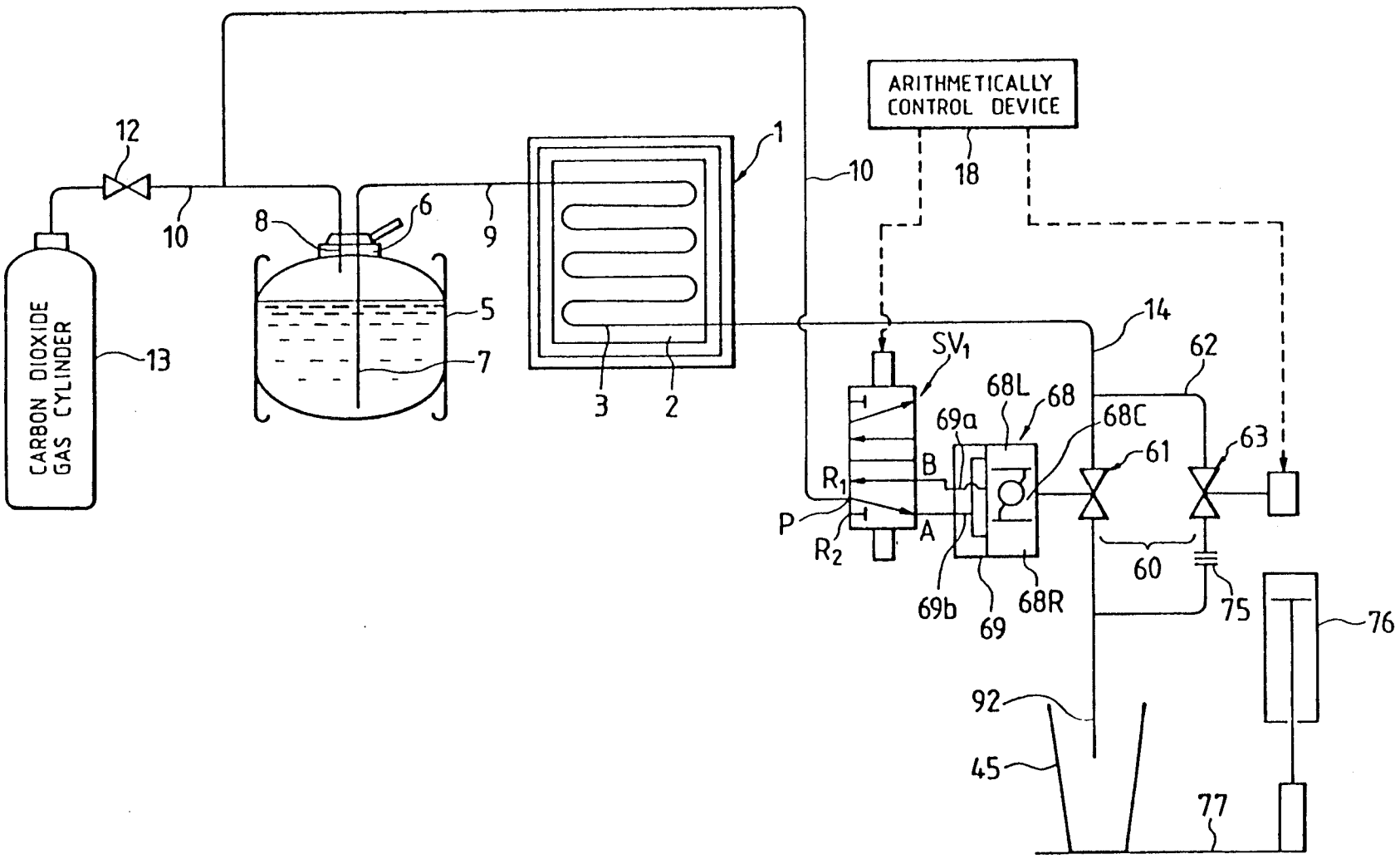
FIG. 8 is a basic structural view showing a third embodiment of a draught beer dispensing system according to the present invention.

FIG. 8 is a basic structural view of a draught beer dispensing system. In FIG. 8, the reference numeral 1 designates a dispenser. The dispenser 1 has a cooling coil 3 within a cooling tank 2, and a heat exchange is carried out in the cooling coil 3 so as to cool beer in the cooling coil 3. The dispenser 1 has a freezer (not shown) installed to cool a cooling medium (for example, water) within the cooling tank 2. A beer supplying pipe 14 is provided on the end of the outlet side of the cooling coil 3, the beer supplying pipe 14 is provided with a beer dispensing valve 60 (described later).

A draught beer keg 5 constituting a draught beer receiving receptacle is installed adjacent to the dispenser 1, and a dispenser head 6 is detachably mounted on a lip portion of the draught beer keg 5. The dispenser head has a siphon pipe 7 suspended within the keg and a carbon dioxide gas supplying pipe 8 in communication with an upper part within the keg, the siphon pipe 7 being communicated with and connected to an inlet side of the cooling coil 3 by a beer supplying pipe 9, the carbon dioxide gas supplying pipe 8 being communicated with and connected to a carbon dioxide gas cylinder 13 through a manual pressure reducing valve 12 by the carbon dioxide gas supplying pipe 10.

Next, a beer dispensing valve 60 will be described in detail with reference to FIG. 8.

The beer dispensing valve 60 is composed of an automatic ball valve 61 constituting an automatic opening closing valve provided on a line of a beer supplying pipe 14 communicated with and connected to the cooling coil 3 of the dispenser 1 and a bypass valve 63 provided on a line of a bypass pipe 62 branched from the beer supplying pipe 14. The automatic valve 61 comprises a valve body 64 shown in FIGS. 9 and 10, a ball 65 inserted within the valve body 64 and having a throughhole 65*a*, a joint 66 connected to the ball 65 and a valve opening and closing cylinder 68 for rotating the ball 65 by 90 degree. The valve body 64 is interiorly provided with a pair of left and right ball seats 67*a* and 67*b* so as to hold the ball 65 therebetween, thereby sealing the outer peripheral surface of the ball 65.

Figure 10:
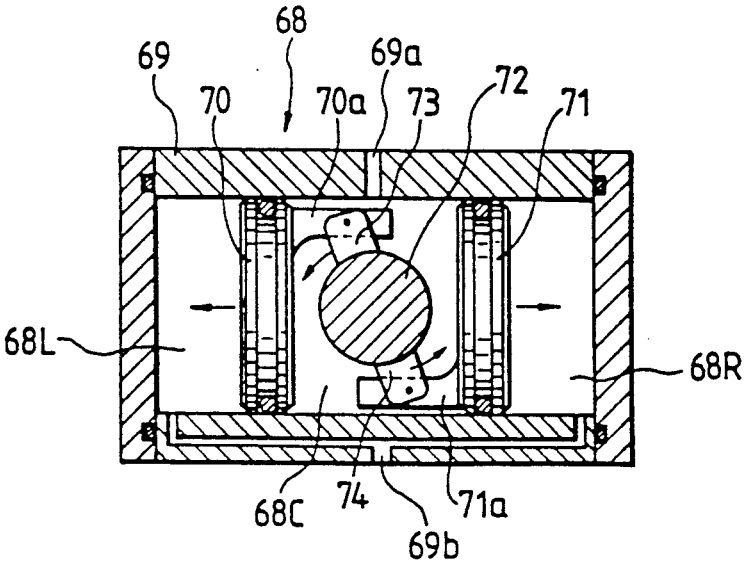
FIG. 10 is a longitudinal sectional view taken on line X—X of FIG. 9.

A pair of left and right pistons 70 and 71 are slidably fitted in an outer tube 69 of a valve opening and closing cylinder 68, and arms 70*a* and 71*a* are integrally projected inwardly of the pistons 70 and 71 (see FIG. 10). A rotational shaft 72 rotatably supported on the outer tube 69 and the arms 70*a* and 71*a* are connected by links 73 and 74.

On the other hand, the outer tube 69 is formed with working fluid supplying paths 69*a* and 69*b* for supplying working fluids into the cylinder as shown in FIG. 10.

Then, when the working fluid flows from the working fluid supplying path 69*a* into a central chamber 68*c*, the pistons 70 and 71 move in a direction as indicated by arrow so as to be apart from each other. As a result, the links 73 and 74 rotate in a direction as indicated by arrow till they assume a horizontal condition and the rotational shaft 72 rotates by approximately 90 degree whereby the valve is opened. At this time, fluids within a right chamber 68R and a left chamber 68L are discharged from the working fluid supplying path 69*b*. On the other hand, when the working fluid flows into the right chamber 68R and left chamber 68L from the working fluid supplying path 69*b*, the pistons 70 and 71 move so as to close to each other, and the links 73 and 74 and the rotational shaft 72 rotate in a direction opposite to the former whereby the valve is closed. At this time, the working fluid in the central chamber 68 C is discharged from the working fluid supplying path 69*a*. While in the present embodiment, a description has been made of the case in which carbon dioxide gas is used as a working fluid for the cylinder, it is to be noted of course that air may be used.

In the automatic ball valve 61 constructed as mentioned above, the working fluid supplying paths 69*a* and 69*b* provided within the outer tube 69 are communicated with and connected to the carbon dioxide supplying pipe 10 through an electromagnetic valve $SV_1$. The electromagnetic valve $SV_1$ is connected to the control device 18, and a solenoid is energized from the control device to switch a flowpassage.

The bypass valve 63 is also connected to the control device 18, and a solenoid is energized from the control device 18 to fully open and close the bypass valve 63. Immediately after the bypass valve 63, an orifice 75 having a predetermined diameter is provided, and beer liquids are throttled by the orifice to produce beer foam.

Next, the operation of the third embodiment of the beer dispensing system according to the present invention will be described with reference to FIG. 8.

When draught beer is not dispensed, the automatic ball valve 61 is in a closed state as shown in FIG. 8. That is, the carbon dioxide gases which are working fluids of the automatic ball valve 61 are supplied from the carbon dioxide gas cylinder 13 to a port P of the electromagnetic valve $SV_1$ through the supplying pipe 10. Then, the carbon dioxide gases pass through a port A from the port P of the electromagnetic valve $SV_1$ and flow into the right chamber 68R and left chamber 68L of the valve opening and closing cylinder 68 through the working fluid supplying path 69*b* within the outer tube 69, whereas the carbon dioxide gases within the central chamber 68C pass through a port B through the working fluid supplying path 69*a* and are discharged from a port $R_1$, and the automatic ball valve 61 is in a fully closed state.

In dispersing draught beer from the draught beer keg 5, the automatic ball valve 61 in the beer dispensing valve 60 is fully opened. That is, when a solenoid of the electromagnetic valve $SV_1$ is energized from the control device 18, a flowpassage of the electromagnetic valve $SV_1$ is switched, and the carbon dioxide gases passes through the port B from the port P and flow into the central chamber 68C of the valve opening and closing cylinder 68 through the working fluid supplying path 69*a*, whereas the carbon dioxide gases within the right chamber 68R and left chamber 68L pass through the port A and the working fluid supplying path 69*b* of the outer tube 69 and are discharged from a port $R_2$, and the automatic ball valve 61 assumes its fully open state. Then, the carbon dioxide gases within the carbon dioxide gas cylinder 13 are supplied into the draught beer keg 5 via the carbon dioxide gas supplying pipe 8 of the dispenser head 6 through the carbon dioxide gas supplying pipe 10, and draught beer within the keg 5 is supplied to the cooling coil 3 of the dispenser 1 under the pressure of the thus supplied carbon dioxide gases and cooled therein. Then, the draught beer passes through the beer supplying pipe 14, the automatic ball valve 61 and the dispensing nozzle 92 and is dispensed as beer liquid into the receptacle 45 placed on a table 77 at an up position by an air cylinder 76. It is noted that the table 77 is elevated by the air cylinder 76. At this time, the tip of the dispensing nozzle 92 is positioned within the receptacle 45. At the time when a predetermined quantity (about 70% of a receptacle capacity) of beer liquid is dispensed into the receptacle 45, a flowpassage of the electromagnetic valve $SV_1$ is switched, and the automatic ball valve 61 is fully closed to terminate dispensing of beer liquid. At this time, the table 77 is moved down by the air cylinder 76, and the tip of the dispensing nozzle 92 is positioned slightly upwardly of the receptacle 45. At the same time, the bypass valve 63 is opened by the control device 18, and the draught beer is guided to the bypass pipe 62 branched from the beer supplying pipe 14. The draught beer is caused to pass through the orifice 75 to thereby produce beer foam, which is dispensed into the receptacle 45. When the receptacle 45 is filled with beer foam, the bypass valve 63 is closed to terminate the step of dispensing draught beer.

According to the present invention, the liquid beer can be dispensed in a state wherein the automatic opening and closing valve provided on the beer dispensing pipe is opened; the beer foam can be dispensed in a state wherein said automatic opening and closing valve is closed and the bypass valve provided on the bypass pipe is opened; the foaming function in addition to the beer dispensing function can be provided; and a necessary and sufficient quantity of been foam as well as dispensing of liquid beer can be dispensed.

Figure 11:
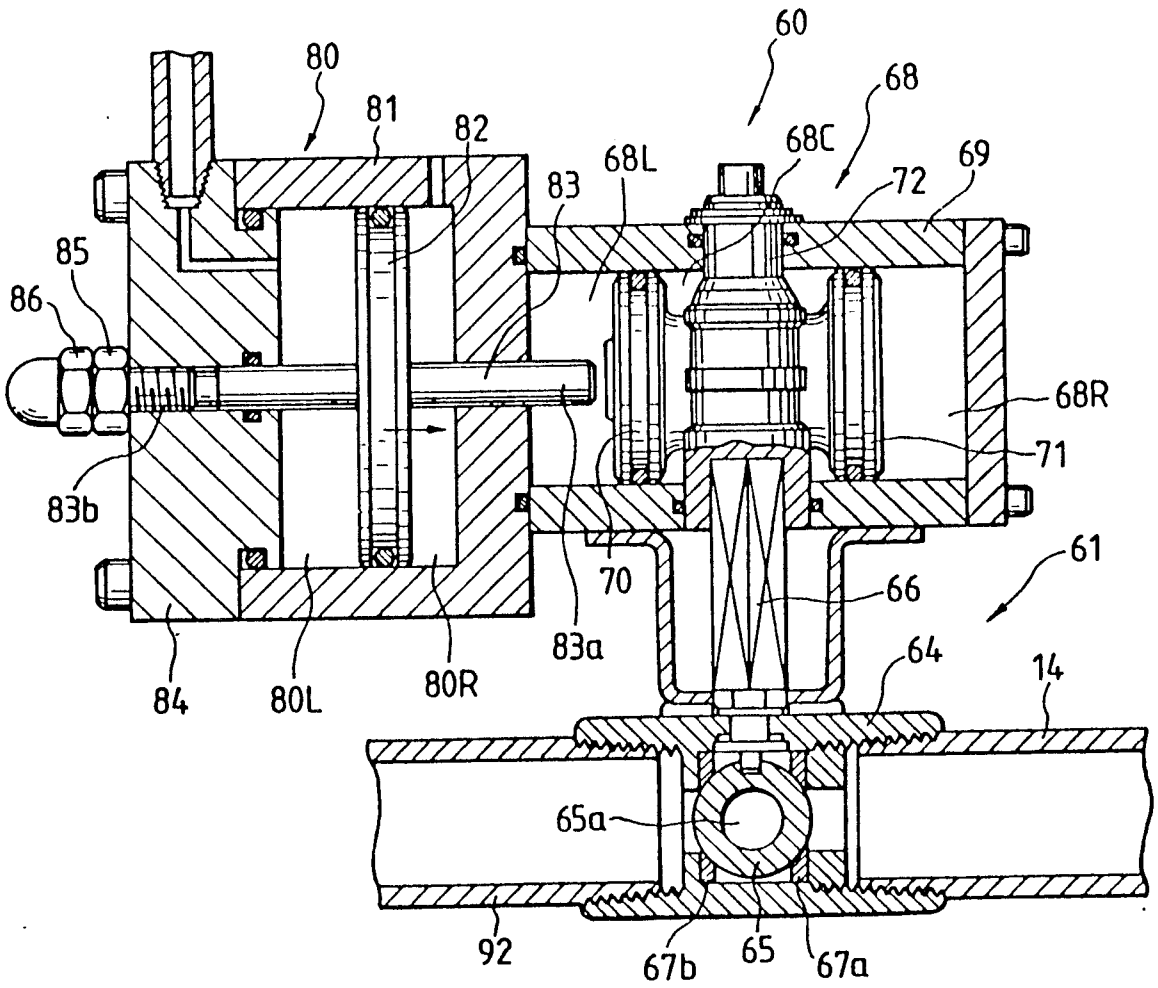
FIG. 11 is a sectional view showing a fourth embodiment of a draught beer dispensing system according to the present invention.

A fourth embodiment of a draught beer dispensing system according to the present invention will be described with reference to FIGS. 11 to 13.

Figure 9:
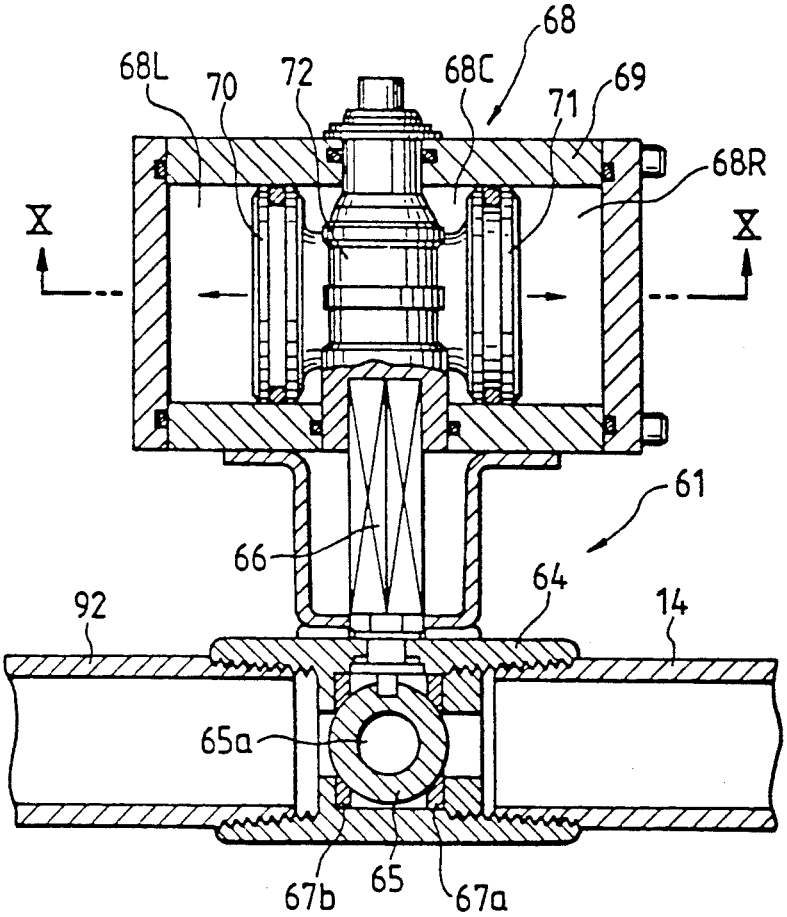
FIG. 9 is a sectional view of an automatic ball valve in a draught beer dispensing system.

In the present embodiment, on the automatic ball valve 61 shown in FIG. 9 is provided an intermediate stopping cylinder 80 for bringing the automatic ball valve 61 into a partly open state to thereby constitute the beer dispensing valve 60 shown in FIG. 4. That is, a separate outer tube 81 is connected to one side end of the outer tube 69, and a rod 83 is integrally provided on a piston 82 slidably provided within the outer tube 81. The outer tube 81 is closed by a closing plate 84. A side end 83*a* of the rod 83 is designed so that the side end 83*a* may be moved in and out of the outer cylinder 69 whereby when the side end 83*a* of the rod 83 is projected, the sliding movement of the piston 70 is defined.

The rod 83 has the other side end formed with a thread 83*b*, and an adjusting nut 85 and a lock nut 86 are threadedly engaged with the thread 83*b*. The tightening position of the adjusting nut 85 and lock nut 86 can be adjusted to adjust a projecting degree of the rod 83 into the outer tube 69. Accordingly, the movement of the piston 70 is restrained upon contact with the end face 83*a* of the rod 83, so that the opening degree of the valve can be controlled.

Figure 12:
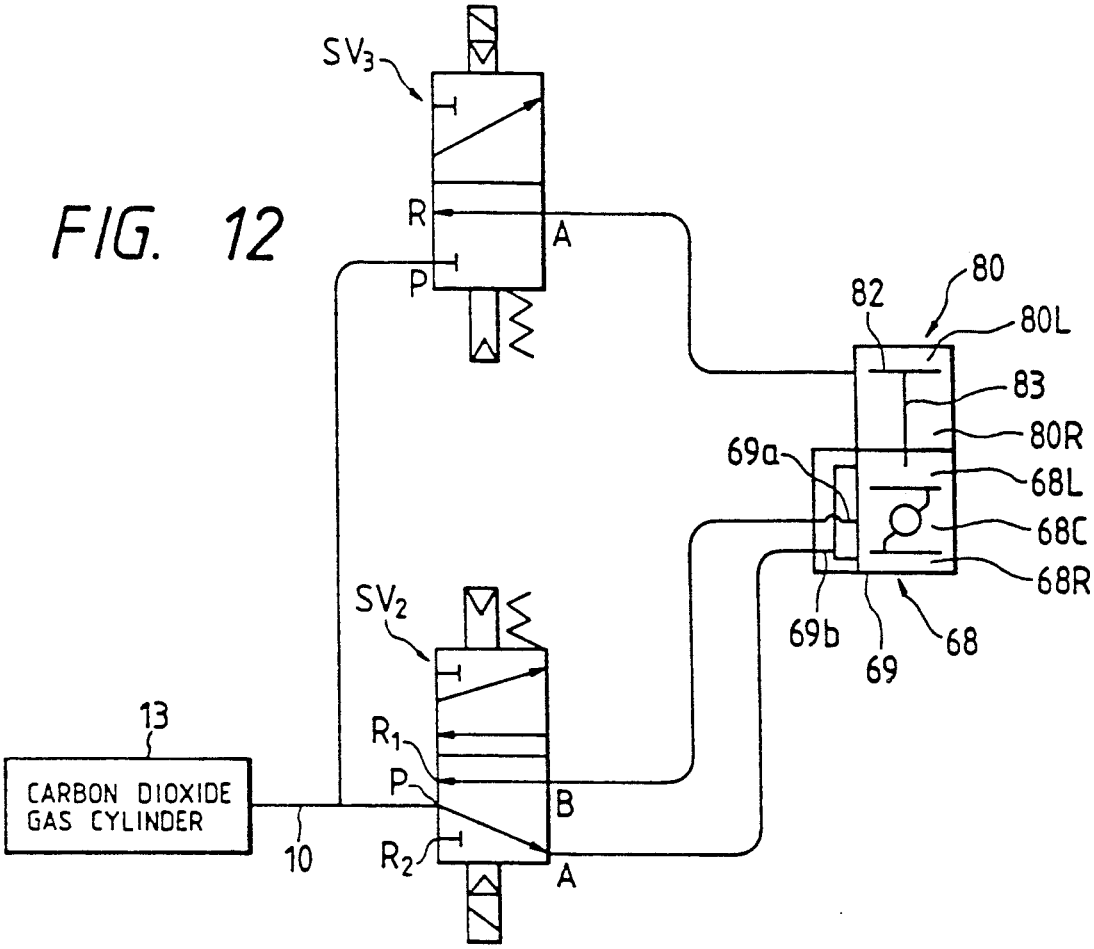
FIG. 12 shows a piping system in the fourth embodiment.

The valve opening and closing cylinder 68 in the beer dispensing valve 60 constructed as mentioned above is communicated with and connected to the carbon dioxide gas supplying pipe 10 through an electromagnetic valve $SV_2$ as shown in FIG. 12, and the intermediate stopping cylinder 80 is communicated with and connected to the carbon dioxide gas supplying pipe 10 through an electromagnetic valve $SV_3$.

Next, the operation of the fourth embodiment of the draught beer dispensing system according to the present invention constructed as described above will be described with reference to a controlling electric circuit shown in FIG. 13.

Figure 13:
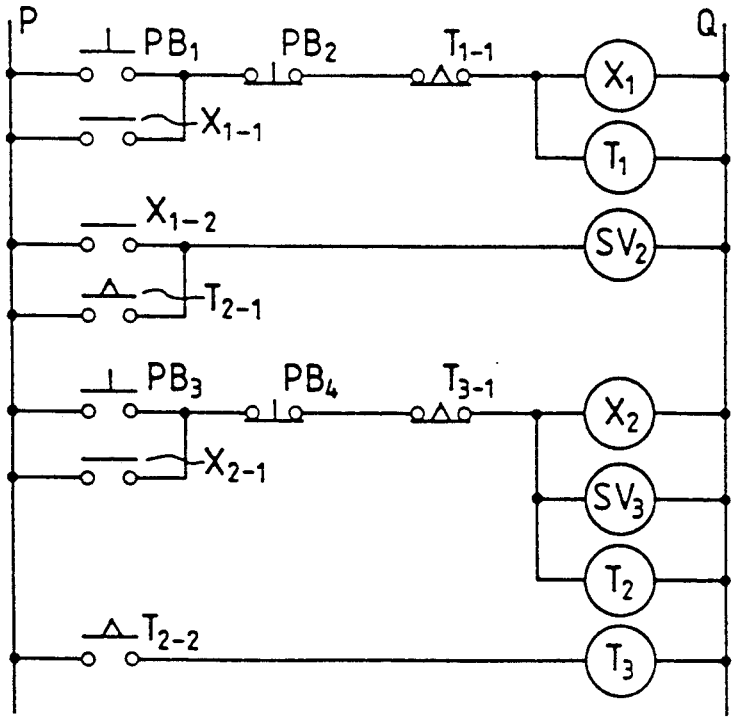
FIG. 13 shows a controlling electric circuit in the fourth embodiment.

When a power source of a beer dispensing system is turned ON, a voltage is applied between P and Q of FIG. 13. Then, when a liquid-out button $PB_1$ provided on the control device 18 is depressed, a relay $X_1$ is turned ON to close auxiliary contacts $X_{1\text{-}1}$ and $X_{1\text{-}2}$ of the relay $X_1$ and the electromagnetic valve $SV_2$ is turned ON whereby a flowpassage switching is carried out and the relay $X_1$ is self retained. And, the carbon dioxide gases pass through the port B from the port P of the electromagnetic valve $SV_2$ and flow into the central chamber 68C of the valve opening and closing cylinder 68 through the working fluid supplying path 69*a* within the outer tube 69. With this, the carbon dioxide gases within the right chamber 68R and left chamber 68L pass through the port A and the working fluid supplying path 69*b* within the outer tube 69 and are discharged through the port $R_2$, and the automatic ball valve 61 assumes its fully open state to dispense beer liquid into the receptacle 45. When a timer relay $T_1$ which started counting time simultaneously with turning-ON of the liquid out button $PB_1$ is timed up, the auxiliary contact $T_{1\text{-}1}$ is opened to release the self-retaining of the relay $X_1$, and the auxiliary contact $X_{1\text{-}2}$ is opened whereby the electromagnetic valve $SV_2$ is turned OFF and the automatic ball valve 61 is fully closed. By that time, a predetermined quantity of beer liquid is dispensed into the receptacle 45. If a push button $PB_2$ is depressed, the self retaining of the relay $X_1$ can be released at any time.

Next, when a foaming button $PB_3$ is depressed, a relay $X_2$ is turned ON and an auxiliary contact $X_{2\text{-}1}$ is closed, whereby the relay $X_2$ is self-retained and at the same time an electromagnetic valve $SV_3$ is turned ON to bring the port P and port A into communication with each other. The carbon dioxide gases are supplied from the carbon dioxide gas supplying pipe 10 to the left chamber 80L of the intermediate stopping cylinder 80 and gases within the right chamber 80R are released to atmosphere. The piston 82 moves in a direction as indicated by arrow in FIG. 11 and one side end 83*a* of the rod 83 projects into the outer tube 69. When a timer relay $T_2$ which started counting time simultaneously when the foaming button $PB_3$ is turned ON is timed up, the auxiliary contact $T_{2\text{-}1}$ is closed and the electromagnetic valve $SV_2$ is turned ON to effect a flowpassage switching. The carbon dioxide gases again pass through the port B from the port P of the electromagnetic valve $SV_2$ and flow into the central chamber 68C of the valve opening and closing cylinder 68 through the working fluid supplying path 69*a* within the outer tube 69. With this, the carbon dioxide gases within the right chamber 68R and left chamber 68L pass through the port A and the working fluid supplying path 69*b* within the outer tube 69 and are discharged through the port $R_2$. The pistons 70 and 71 move so as to be apart from each other, and the automatic ball valve 61 begins to open. The piston 70 comes into contact with the projected rod 83 and the automatic ball valve 61 assumes a partly open state. The beer liquid supplied from the beer supplying pipe 14 is formed, as it passes through the partly opened automatic ball valve 61, into beer foam which is dispensed into the receptacle 45. When a timer relay $T_3$ which started counting time by the closure of the auxiliary contact $T_{2\text{-}2}$ of the timer relay $T_2$ is timed up, the auxiliary contact $T_{3\text{-}1}$ is opened and the self-retaining of the relay $X_2$ is released whereby the electromagnetic valves $SV_2$ and $SV_3$ are turned OFF and the automatic ball valve 61 is fully closed to terminate dispensing of beer foam. By that time, a predetermined quantity of beer foam is dispensed into the receptacle 45.

According to the present invention, the liquid beer can be dispensed in such a manner that the beer dispensing valve is fully opened, the beer foam can be dispensed in such a manner that the beer dispensing valve is a partly open state. That is, the foaming function in addition to the beer dispensing function can be provided and a necessary and sufficient quantity of foam as well as dispensing of liquid beer can be dispensed.

Next, a fifth embodiment of a draught beer dispensing system according to the present invention will be described with reference to FIGS. 14 and 15.

In the present embodiment, as a beer dispensing valve, the automatic ball valve 61 shown in FIG. 9 is used, and four electromagnetic valves $SV_4$ to $SV_7$ are provided in order to cause the automatic ball valve 61 to take three positions, such as fully open, fully closed and partly open.

Figure 14:
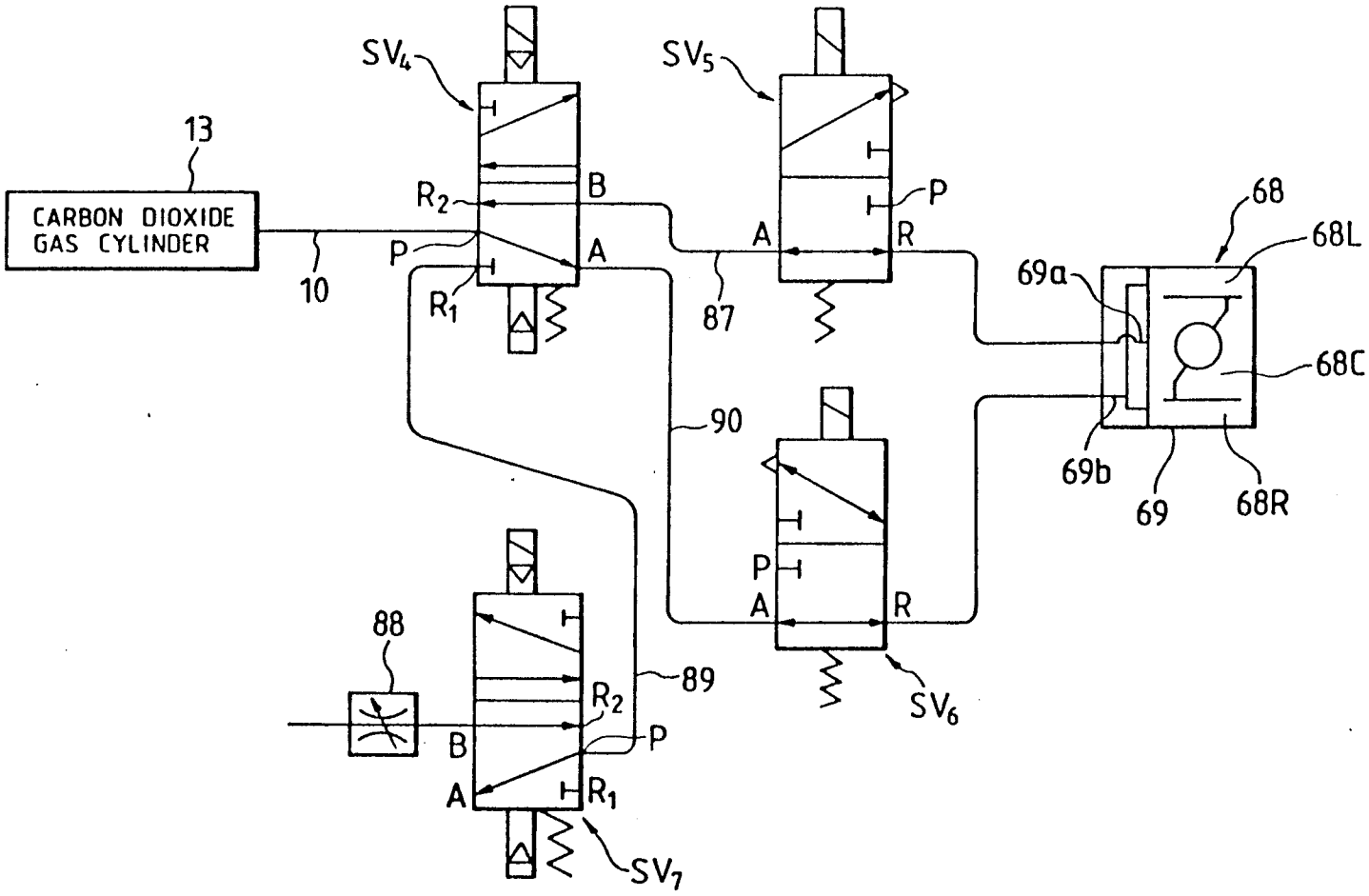
FIG. 14 shows a piping system showing a fifth embodiment of a draught beer dispensing system according to the present invention.

In FIG. 14, the central chamber 68C of the valve opening and closing cylinder 68 in the automatic ball valve 61 is connected to a port R of an electromagnetic valve $SV_5$ through the working fluid supplying path 69*a* within the outer tube 69, and the right chamber 68R and left chamber 68L are connected to a port R of an electromagnetic valve $SV_6$ through the working fluid supplying path 69*b* within the outer tube 69. Port P of the electromagnetic valve $SV_4$ is connected to the carbon dioxide gas supplying pipe 10, port B of the electromagnetic valve $SV_4$ is connected to port A of the electromagnetic valve $SV_5$ through a connection pipe 87, and port A of the electromagnetic valve $SV_4$ is connected to port A of the electromagnetic valve $SV_6$ through a connection pipe 90.

Port B of an electromagnetic valve $SV_7$ is opened to atmosphere through a throttle valve 88, and port P of the electromagnetic valve $SV_7$ is connected to port $R_1$ of the electromagnetic valve $SV_4$ through a connection pipe 89.

Next, the operation of the draught beer dispensing system constructed as described above will be described with reference to a controlling electric circuit shown in FIG. 15.

Figure 15:
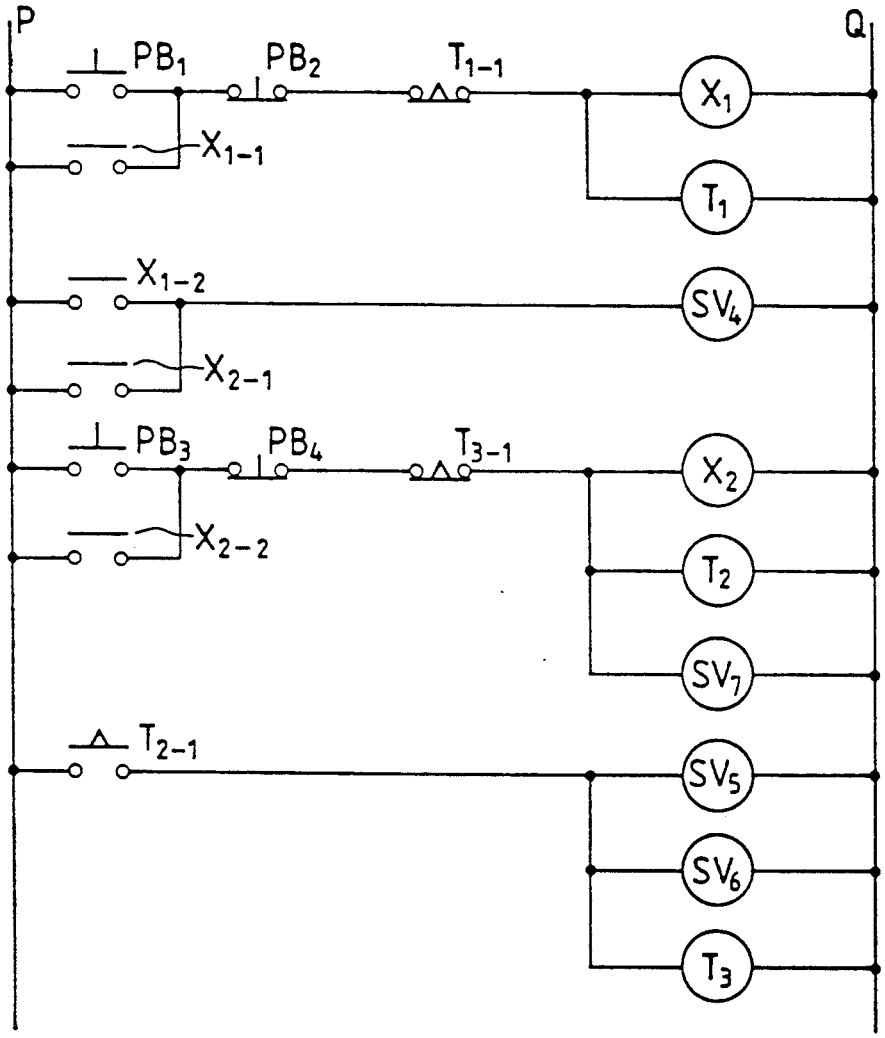
FIG. 15 shows a controlling electric circuit in the fifth embodiment.

When a power source of a beer dispensing system is turned ON, a voltage is applied between P and Q of FIG. 15. Then, when a liquid-out button $PB_1$ provided on the control device 18 is depressed, a relay $X_1$ is turned ON to close auxiliary contacts $X_{1-1}$ and $X_{1-2}$ of the relay $X_1$ and the electromagnetic valve $SV_4$ is turned ON whereby a flowpassage switching is carried out and the relay $X_1$ is self-retained. And, the carbon dioxide gases pass through the port B from the port P of the electromagnetic valve $SV_4$ by the carbon dioxide supplying pipe 10 and enter the connection pipe 87 and further pass through the port R from the port A of the electromagnetic valve $SV_5$ and pass through the working fluid supplying path 69*a* within the outer tube 69 and are supplied into the central chamber 68C of the valve opening and closing cylinder 68. On the other hand, the right chamber 68R and left chamber 68L of the valve opening and closing cylinder 68 are communicated with atmosphere through the working fluid supplying path 69*b*, port A from port R of the electro-magnetic valve $SV_6$, connection pipe 90, port $R_1$ from port A of the electromagnetic valve $SV_4$, connection pipe 89, and port A from port P of the electromagnetic valve $SV_7$. Accordingly, the automatic ball valve 61 assumes its fully open state, and the beer liquid is dispensed into the receptacle 45. When a timer $T_1$ which started counting time simultaneously with the turning ON of a liquid-out button $PB_1$ is timed up, the auxiliary contact $T_{1-1}$ is opened to release the self-retaining of the relay $X_1$ whereby the auxiliary contact $X_{1-2}$ is opened, the electromagnetic valve $SV_4$ is turned OFF and the automatic ball valve 61 is fully closed. By that time, a predetermined quantity of beer liquid is dispensed into the receptacle 45. If the push button $PB_2$ is depressed, the self-retaining of the relay $X_1$ is released at any time.

Then, when a foaming button $PB_3$ is depressed, a relay $X_2$ is turned ON to close auxiliary contacts $X_{2-1}$ and $X_{2-2}$, and the electromagnetic valve $SV_4$ is turned ON and electromagnetic valve $SV_7$ is turned ON to effect flowpassage switching. Accordingly, the carbon dioxide gases pass through the port B from the port P of the electromagnetic valve $SV_4$ and enter the connection pipe 87, in a manner similar to that as previously mentioned, and further pass through the port R from the port A of the electromagnetic valve $SV_5$ and thence the working fluid supplying path 69*a* within the outer tube 69 into the central chamber 68C of the valve opening and closing cylinder 68. On the other hand, the right chamber 68R and leftr chamber 68L of the opening and closing cylinder 68 are communicated with the port P of the electromagnetic valve $SV_7$ in a manner similar to that as previously mentioned but the port P of the electromagnetic valve $SV_7$ is communicated with the port B, and therefore, the exhaust from the right chamber 68R and left chamber 68L is throttled by the throttle valve 88 to slow down the moving speed of the pistons 70 and 71. The timer relay $T_2$ having been actuated by turning-ON the foaming button $PB_3$ during the slow movement of the pistons 70 and 71 is timed up, and therefore, the auxiliary contact $T_{2-1}$ is closed and the electromagnetic valves $SV_5$ and $SV_6$ are turned ON. Thereby the port R of the electromagnetic valve $SV_5$ and the port R of the electromagnetic valve $SV_6$ are closed, and both intake and exhaust sides of the valve opening and closing cylinder 68 are closed, and therefore the automatic ball valve 61 stops at its partly open position. Therefore, the beer liquid supplied from the beer supplying pipe 14 is throttled when passing through the automatic ball valve 61 and formed into beer foam to be dispensed into the receptacle 45. When the timer relay $T_3$ which started counting time by the closure of the auxiliary contact $T_{2-1}$ of the timer relay $T_2$ is timed up, the auxiliary contact $T_{3-1}$ is opened to release the self-retaining of the relay $X_2$ and the electromagnetic valves $SV_4$ to $SV_7$ are turned OFF and the automatic ball valve 61 is fully closed, thus terminating dispensing of beer foam. By that time, a predetermined quantity of beer foam is dispensed into the receptacle 45.

In the present embodiment, a partly opening degree of the automatic ball valve 61 can be changed by suitably changing the time till the timer relay $T_2$ is timed up. Further, in the present embodiment, the automatic ball valve is partly opened when the timer relay $T_2$ is timed up in the midst between the fully closed state and the open state of the automatic ball valve. However, it is noted that, for example, a pin is mounted on a rotational shaft 72, a limit switch is provided on the outer tube 69 and movement of the automatic ball valve is detected by the limit switch to actuate the electromagnetic valves $SV_5$ and $SV_6$ so that the automatic ball valve may be partly opened.

While in the description of the controlling electric circuit shown in FIGS. 13 and 15, the semi-automatic mode has been described in which the liquid-out button $PB_1$ and the foaming button $PB_3$ are independent and manual operation is employed, it is to be noted of course that the automatic mode can also be applied in which the sequence from the liquid-out step to the foaming step is progressed automatically by the timer.

Further, FIGS. 13 and 15 are provided to explain the principle of operation and therefore the electric circuit with individual parts combined has been described. It is to be noted however that if the arithmetically control device using a microcomputer as mentioned in the first or second embodiment is used, it can be of a software timer using output results of the arithmetically control device in place of a timer using individual parts.

Next, a sixth embodiment of a draught beer dispensing system according to the present invention will be described with reference to FIGS. 16 to 23.

Figure 16:
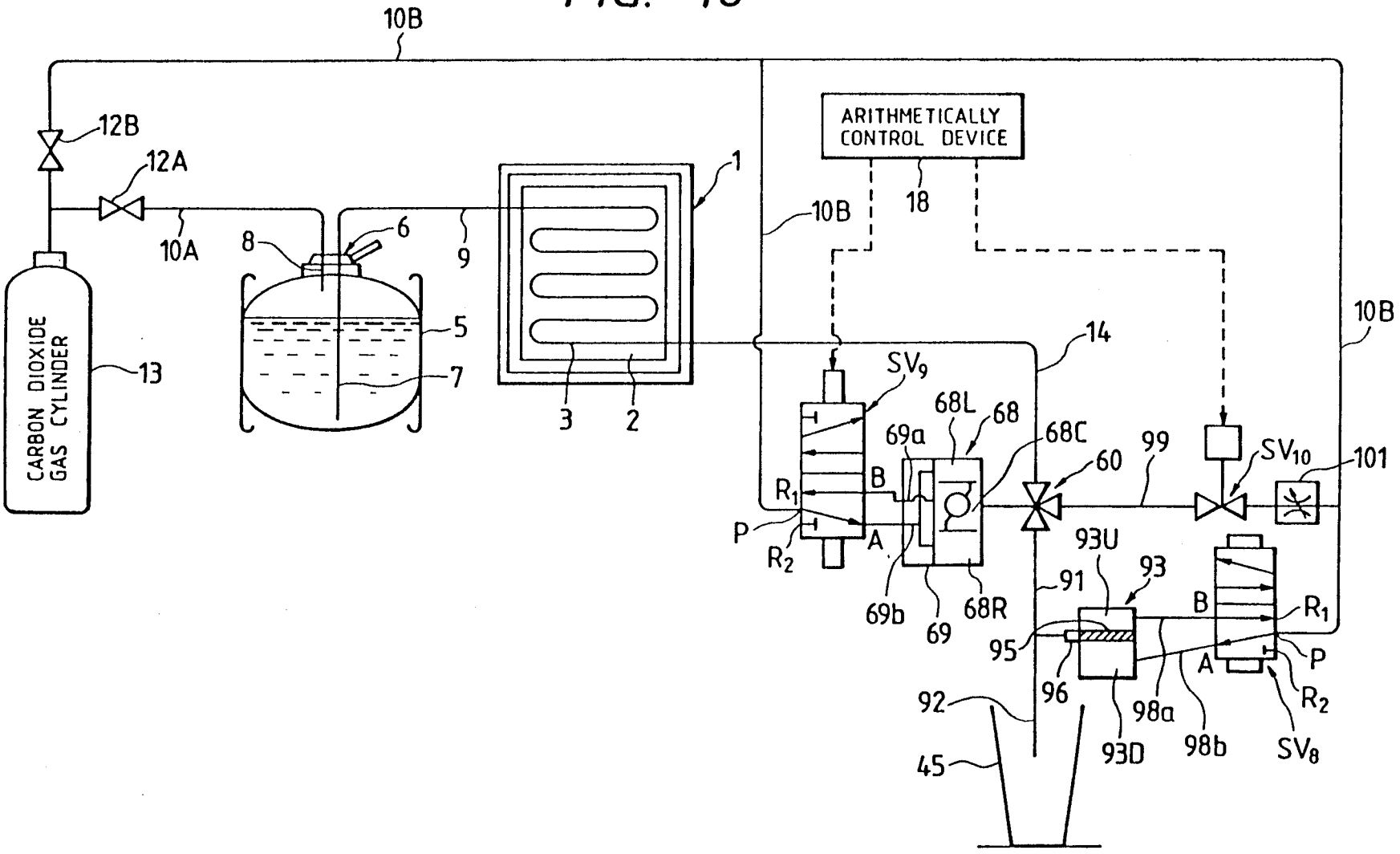
FIG. 16 is a basic structural view showing a sixth embodiment of a draught beer dispensing system according to the present invention.

FIG. 16 is a basic structural view of a draught beer dispensing system. In FIG. 16, the reference numeral 1 designates a dispenser. The dispenser 1 has a cooling coil 3 within a cooling tank 2, and a heat exchange is carried out in the cooling coil 3 so as to cool beer in the cooling coil 3. The dispenser 1 has a freezer (not shown) installed to cool a cooling medium (for example, water) within the cooling tank 2. A beer supplying pipe 14 is provided on the end of the outlet side of the cooling coil 3, and a beer dispensing valve 60 is connected to the beer supplying pipe 14.

A draught beer keg 5 constituting a draught beer receiving receptacle is installed adjacent to the dispenser 1, and a dispenser head 6 is detachably mounted on a lip portion of the draught beer keg 5. The dispenser head 6 has a siphon pipe 7 suspended within the keg and a carbon dioxide gas supplying pipe 8 in communication with an upper part within the keg, the siphon pipe 7 being communicated with and connected to an inlet side of the cooling coil 3 by a beer supplying pipe 9, the carbon dioxide gas supplying pipe 8 being communicated with and connected to a carbon dioxide gas cylinder 13 through a pressure reducing valve 12A by a carbon dioxide gas supplying pipe 10A.

Figure 17:
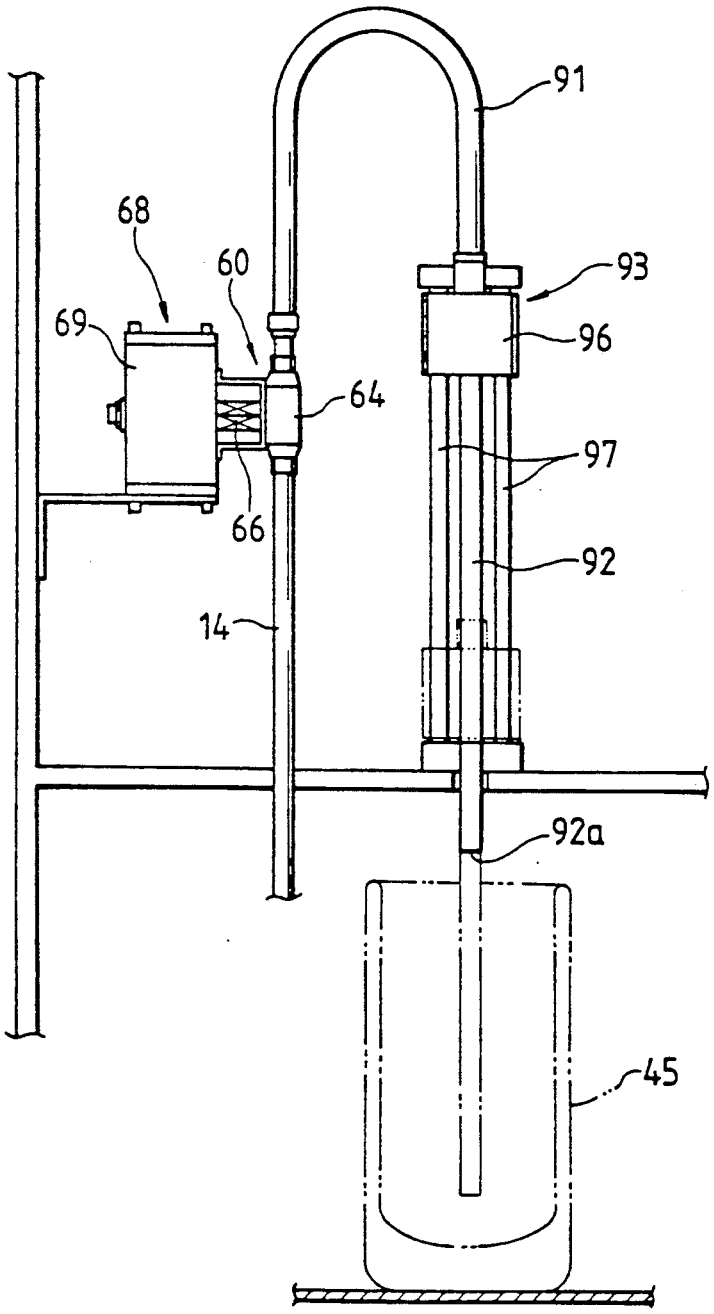
FIG. 17 is an enlarged view showing essential parts of the draught beer dispensing system according to the sixth embodiment.

To the beer dispensing valve 60 is connected a flexible tube 91, as shown in FIG. 17, and to the flexible tube 91 is connected a dispensing nozzle 92.

Figure 18:
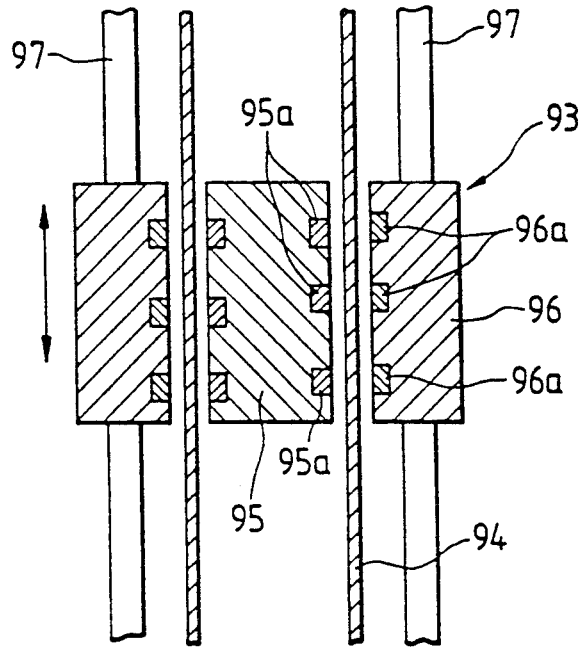
FIG. 18 is a fragmentary sectional view of a rodless cylinder in a draught beer dispensing system.

The dispensing nozzle 92 has its upper end connected to a movable stand 96 of a rodless cylinder 93. The movable stand 96 is slidably supported by vertically extending guide bars 97 and 97 so that when the rodless cylinder 93 is actuated, the movable stand 96 is moved up and down along the guide bars 97 and 97, and the dispensing nozzle 92 is moved up and down. As shown in FIG. 18, the rodless cylinder 93 is composed of an outer tube 94, a piston 95 slidably provided within the outer tube 94 and the aforesaid movable stand 96 slidably fitted with the outer tube 94, whereby when working fluid is supplied into the outer tube 94, the piston 95 is moved up and down with the result that the movable stand 96 is moved up and down by the action of magnetic forces of a permanent magnet 95*a* provided on the piston 95 and a permanent magnet 96*a* provided on the movable stand 96. As the working fluid for actuating the rodless cylinder 93, carbon dioxide gases are used. That is, as shown in FIG. 16, the rodless cylinder 93 is connected to an electromagnetic valve $SV_8$ through connection pipes 98*a* and 98*b*, the electromagnetic valve $SV_8$ being connected to a carbon dioxide gas cylinder 13 via a pressure reducing valve 12B through a carbon dioxide gas supplying pipe 10B.

Figure 19:
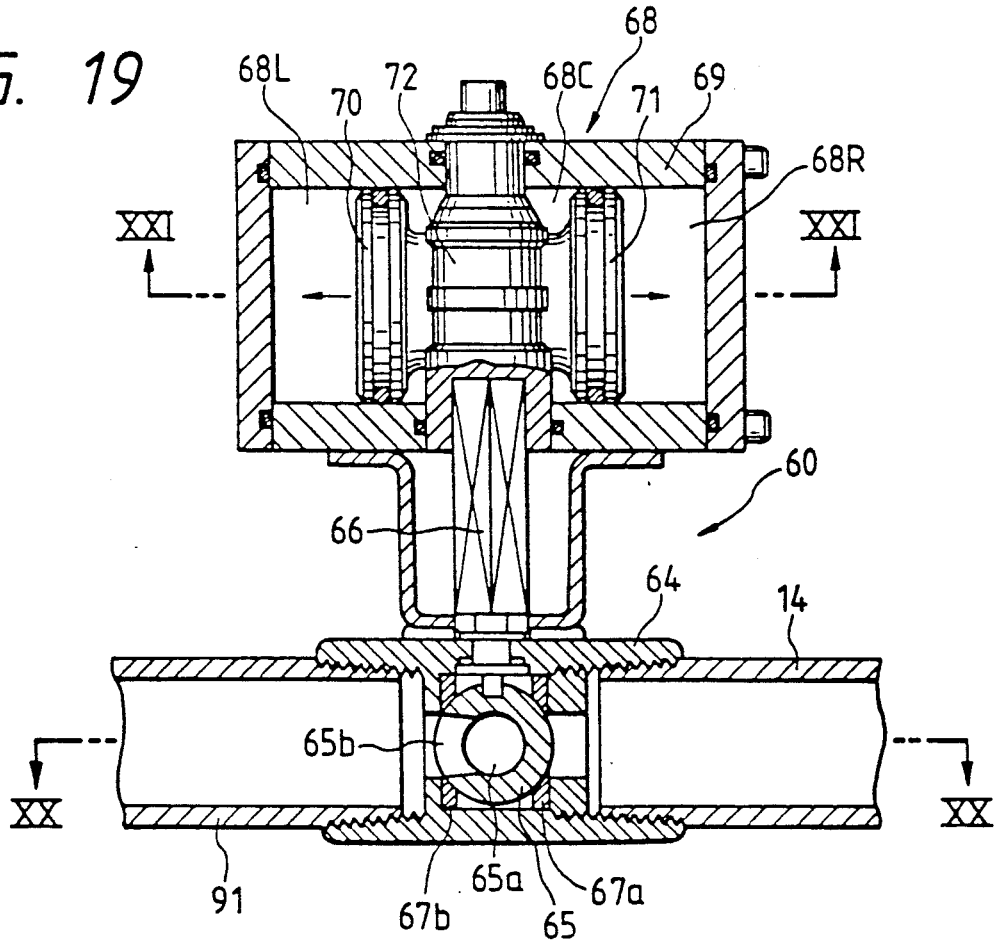
FIG. 19 is a sectional view of a beer dispensing valve in the draught beer dispensing system.
Figure 20:
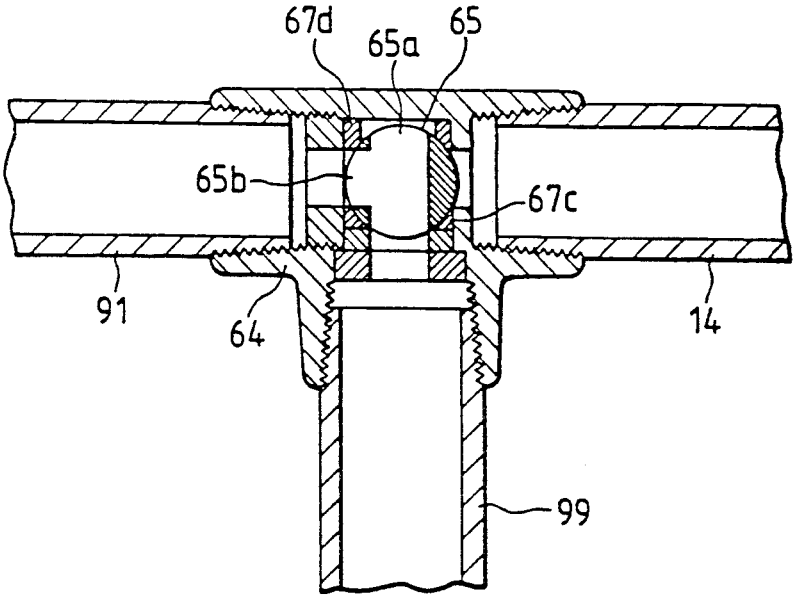
FIG. 20 is a sectional view taken on line XX—XX of FIG. 19.

Next, a beer dispensing valve 60 will be described in detail with reference to FIGS. 19 to 21.

The beer dispensing valve 60 is composed of a three-way valve comprising an automatic ball valve. The automatic beer dispensing valve 60 comprises a valve body 64, a ball 65 inserted into the valve body 64, a joint 66 connected to the ball 65 and an opening and closing cylinder 68 for rotating the ball 65 by 90. The valve body 64 is in the shape of a T-pipe, and to three ports of the valve body 64 are connected a beer supplying pipe 14, a flexible tube 91 and a blow gas supplying pipe 99, respectively, the valve body 64 incorporating therein four ball seats 67*a*, 67*b*, 67*c* and 67*d* so as to encircle the ball 65 to thereby seal the outer peripheral surface of the ball 65. On the other hand, the ball 65 is formed with a through hole 65*a* extending through outer peripheral surfaces opposed to each other and a branched hole 65*b* provided with a phase of 90 with respect to the through hole 65*a*.

Figure 21:
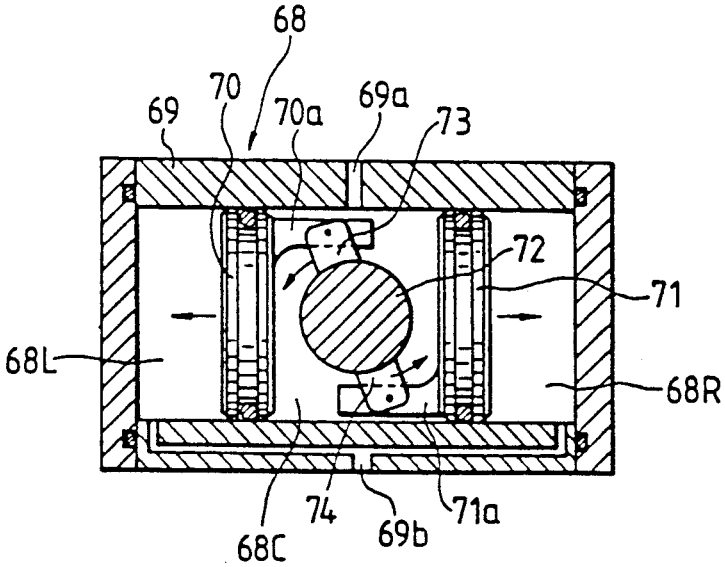
FIG. 21 is a sectional view taken on line XXI—XXI of FIG. 19.

A pair of left and right pistons 70 and 71 are slidably fitted within an outer tube 69 of the valve opening and closing cylinder 68, and arms 70*a* and 71*a* are integrally projected inwardly of the pistons 70 and 71, respectively (see FIG. 21). A rotational shaft 72 rotatably supported on the outer tube 69 and said arms 70*a* and 71*a* are connected by links 73 and 74.

On the other hand, the outer tube 69 is provided with working fluid supplying paths 69*a* and 69*b* for supplying working fluid into the cylinder as shown in FIG. 21.

With this arrangement, when the working fluid flows into a central chamber 68C from the working fluid supplying path 69*a*, the pistons 70 and 71 move in a direction as indicated by arrow so as to be moved away from each other. As a result, the links 73 and 74 rotate in a direction as indicated by arrow till they assume an approximately horizontal state, and the rotational shaft 72 rotates by approximately 90 to open the valve. At this time, the fluids within the right chamber 68R and left chamber 68L are discharged from the working fluid supplying path 69*b*.

On the other hand, when the working fluid flows into the right chamber 68R and left chamber 68L from the working fluid supplying path 69*b*, the pistons 70 and 71 move so as to come closer to each other and the links 73 and 74 and the rotational shaft 72 rotate in a direction opposite to that as described above to close the valve. At this time, the working fluid within the central chamber 68C is discharged from the working fluid supplying path 69*a*. While in the present embodiment, the case where the carbon dioxide gas is used as the working fluid for the cylinder has been described, it is to be noted of course that air may be used.

Next, the operation of the sixth embodiment of the draught beer dispensing system according to the present invention will be described with reference to FIGS. 22 and 23.

Figure 22:
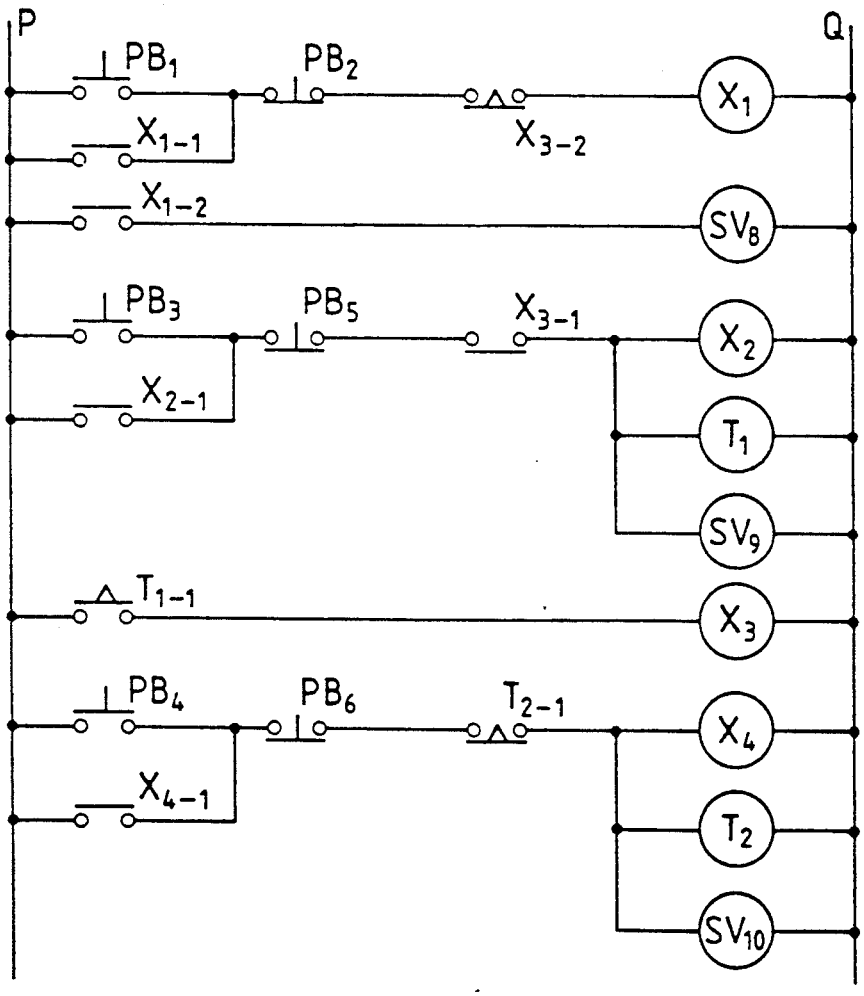
FIG. 22 shows a controlling electric circuit in a draught beer dispensing system.
Figure 23B:
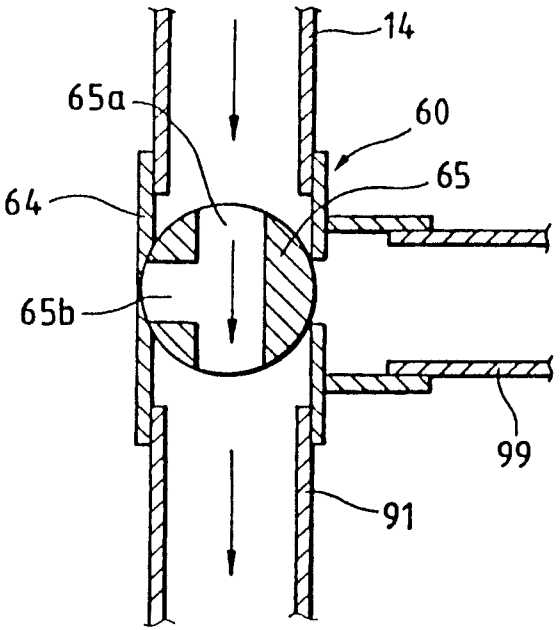
FIG. 23 is an explanatory view of operation of a draught beer dispensing system.
Figure 23A:
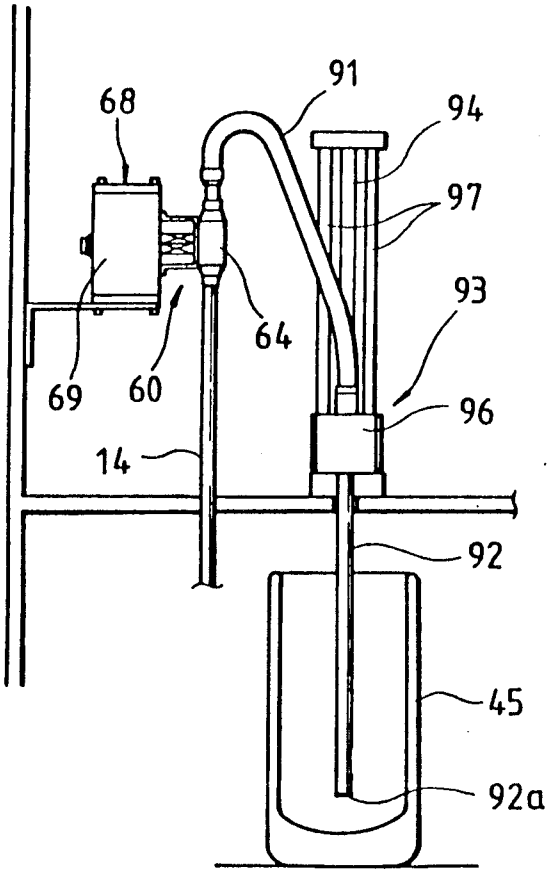
Figure 23D:
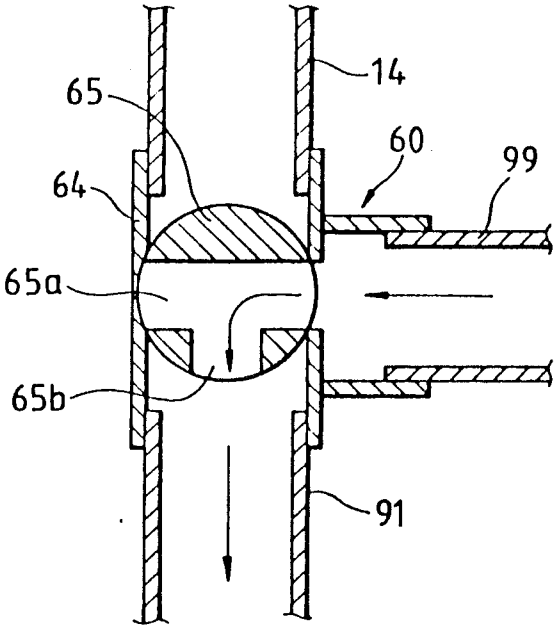
Figure 23C:
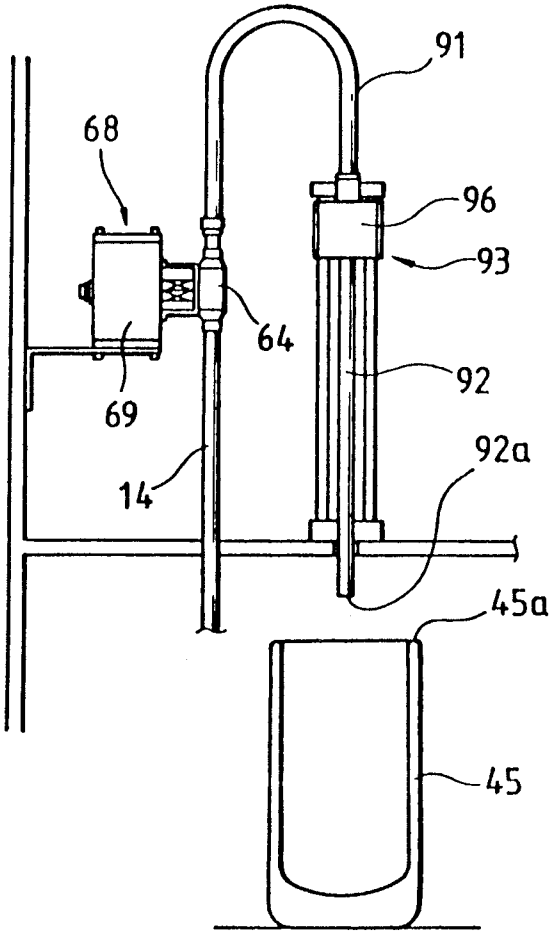

When a power source of the draught beer dispensing system is turned ON, a voltage is applied between P and Q of FIG. 22. Then, when a nozzle elevating button $PB_1$ provided on the control device 18 is depressed, a relay $X_1$ is turned ON to close auxiliary contacts $X_{1\text{-}1}$ and $X_{1\text{-}2}$ of the relay $X_1$, and the electromagnetic valve $SV_8$ is turned ON to effect flowpassage switching and the relay $X_1$ is self retained. And the carbon dioxide gases flow into the port P of the electromagnetic valve $SV_8$ from the carbon dioxide gas supplying pipe 10B and flow into an upper chamber 93U of the rodless cylinder 93 passing through the port B from the port P. On the other hand, gases within a lower chamber 93D are released to atmosphere, and the piston 96 is slidably moved downward, thereby the movable stand 96 and the dispensing nozzle 92 connected thereto are moved downward with the result that the tip 92*a* of the dispensing nozzle 92 is positioned within the receptacle 45 as shown in FIG. 23(*a*).

Next, when the liquid-out button $PB_3$ is depressed, the relay $X_2$ is turned ON to close the auxiliary contact $X_{2\text{-}1}$ of the relay $X_2$, and the electromagnetic valve $SV_9$ is turned ON to effect flowpassage switching and the relay $X_2$ is self-retained. The carbon dioxide gases pass the port B from the port P of the electromagnetic valve $SV_9$ and flow into the central chamber 69C of the opening and closing cylinder 69 through the working fluid supplying path 69*a* within the outer tube 69. With this, the carbon dioxide gases within the right chamber 68R and left chamber 68L pass through the port $R_2$ from the port A and the working fluid supplying path 69*b* within the outer tube 69 and are discharged, and the beer dispensing valve 60 assumes its fully open state and draught beer is dispensed into the receptacle 45. The state of the beer dispensing valve 60 at that time is shown in FIG. 23(*b*), in which the beer supplying pipe 14 and the flexible tube 91 are communicated through the through hole 65*a* within the ball 65. When the timer relay $T_1$ which started counting time simultaneously with the turning-ON of the liquid-out button $PB_3$ is timed up, the auxiliary contact $T_{1\text{-}1}$ is closed, the relay $X_3$ is turned ON, the auxiliary contact $X_{3\text{-}1}$ of the relay $X_3$ is opened, the self retaining of the relay $X_2$ is released, the electromagnetic valve $SV_9$ is turned OFF, and the beer dispensing valve 60 is fully closed. By that time, a fixed quantity of draught beer is dispensed into the receptacle 45.

After the slight time-elapsing after termination of beer dispensing, a time auxiliary contact $X_{3\text{-}2}$ of a relay $X_3$ is opened, the relay $X_1$ is turned OFF, the auxiliary contacts $X_{1\text{-}1}$ and $X_{1\text{-}2}$ of the relay $X_1$ are opened, the self-retaining of the relay $X_1$ is released and the electromagnetic valve $SV_8$ is turned OFF. Thereby the carbon dioxide gases pass through the port A from the port P of the electromagnetic valve $SV_8$ and flow into the lower chamber 93D of the rodless cylinder 93 whereas the carbon dioxide gases within the upper chamber 93U is released to atmosphere, the piston 95 is slidably moved upwardly, the movable stand 96 and the dispensing nozzle 92 are moved upward, and the tip 92*a* of the dispensing nozzle 92 is positioned upwardly of the upper edge 45*a* of the receptacle 45 as shown in FIG. 23(*c*). It is noted that if the push button $PB_2$ is depressed, the self-retaining of the relay $X_1$ is released at any time, and the dispensing nozzle 9 is moved upward.

When the tip 92*a* of the dispensing nozzle 92 is brought into a position above the upper edge 45*a* of the receptacle 45, the receptacle 45 is removed.

Next, when the blow button $PB_4$ is turned ON, the relay $X_4$ is turned ON, the auxiliary contact $X_{4-1}$ is closed, the relay $X_4$ being self-retained, and at the same time, a blowing electromagnetic opening and closing valve $SV_{10}$ is turned ON, said valve $SV_{10}$ is turned ON, said valve $SV_{10}$ being opened and carbon dioxide gases are supplied from the carbon dioxide gas supplying pipe 10B through a throttle valve 101 and a blow gas supplying pipe 99 to the beer dispensing valve 60. The state of the beer dispensing valve 60 at that time is shown in FIG. 23(*d*), in which the beer supplying pipe 14 is closed by the ball 65, and the blow gas supplying pipe 99 and the flexible tube 91 are communicated through the through hole 65*a* and branched hole 65*b* of the ball 65. As a result, the carbon dioxide gases having a predetermined pressure are introduced into the flexible tube 91 and the dispensing nozzle 92 connected thereto, and the residual beer (along with foam and liquid) within the flexible tube 91 and dispensing nozzle 92 are discharged outside. By this discharging action of the residual beer, a so-called post drip wherein the residual beer drips from the nozzle or the like can be prevented. When the timer relay $T_2$ which started counting time simultaneous with the turning-ON of the relay $X_4$ is timed up, the auxiliary contact $T_{2-1}$ is opened, the self-retaining of the relay $X_4$ is released, and the blowing electromagnetic opening and closing valve $SV_{10}$ is turned OFF, said valve $SV_{10}$ being closed to terminate the blowing step. Reference characters $PB_5$ and $PB_6$ denote automatic process stop buttons, respectively.

While in the present embodiment, the dispensing step of draught beer and the blowing step of beer within nozzle are separately executed, it is to be noted that if a throttling degree of the throttle valve 101 is strongly adjusted, pressure of the carbon dioxide gases sent to the blow gas supplying pipe 99 is extremely lowered, and if the counting time of the timer relay $T_2$ is made to be extremely shorter, the nozzle blowing step after the draught beer dispensing step can also be automatically executed.

According to the present invention, when draught beer is dispensed, the tip of the dispensing nozzle is positioned within the receptacle, and upon termination of dispensing, the tip of the dispensing nozzle can be positioned upwardly of the upper edge of the receptacle. Therefore, excessive foaming when draught beer is dispensed can be prevented. In addition, since when draught beer is dispensed, the distance between the tip of the dispensing nozzle and the receptacle bottom is always constant, a quantity of foam produced is constant and as a result a quantity of beer dispensed into a receptacle can be made to be fixed. Moreover, the beer dispensing work becomes easy, and an operator's load is reduced.

According to the present invention, a beer dispensing valve comprises a three-way valve, and pressure gases can be discharged from one port of the three-way valve to a dispensing nozzle connected to the beer dispensing valve after completion of dispensing beer. Therefore, the residual beer such as foam within the dispensing nozzle can be discharged, and the post-drip can be eliminated in a very short period of time. Moreover, since the dispensing nozzle is empty prior to succeeding dispensing of draught beer, formation of foam in the succeeding dispensing is not stimulated; surplus foam caused by the residual beer can be avoided; and prevention of a post-drip is preferable in view of hygienic point.

Figure 24C:
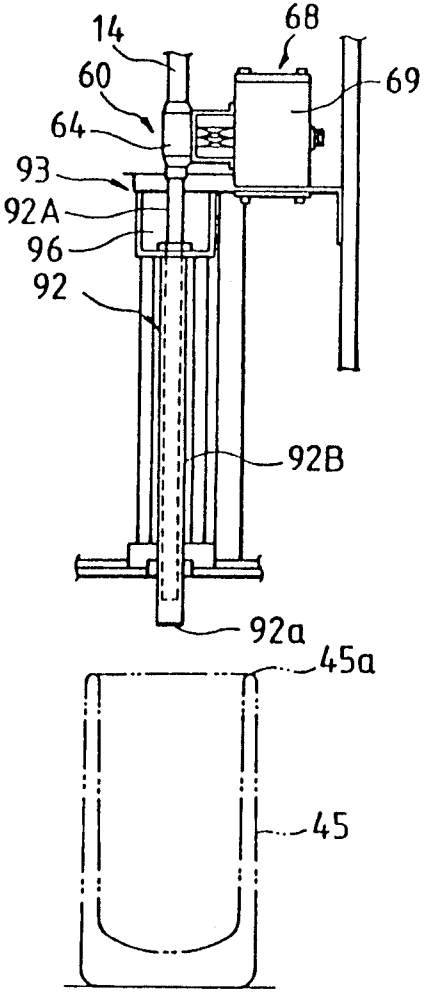
FIG. 24 is a view showing a seventh embodiment of a draught beer dispensing system according to the present invention.
Figure 24B:
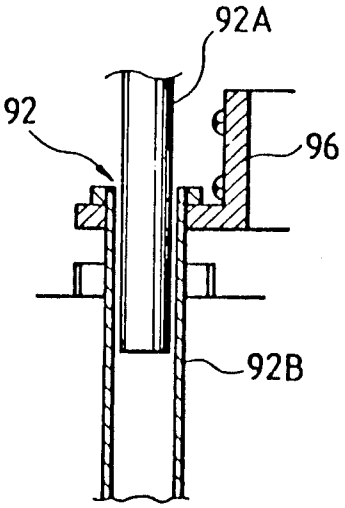
Figure 24A:
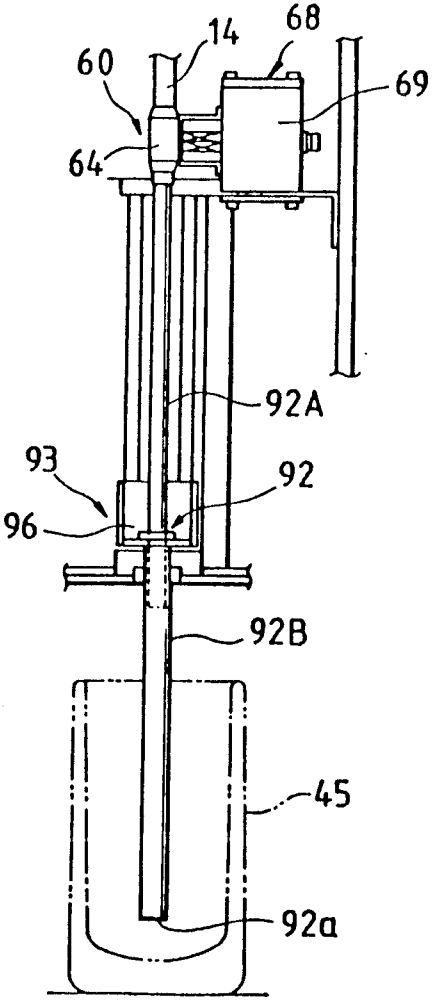
Figure 25:
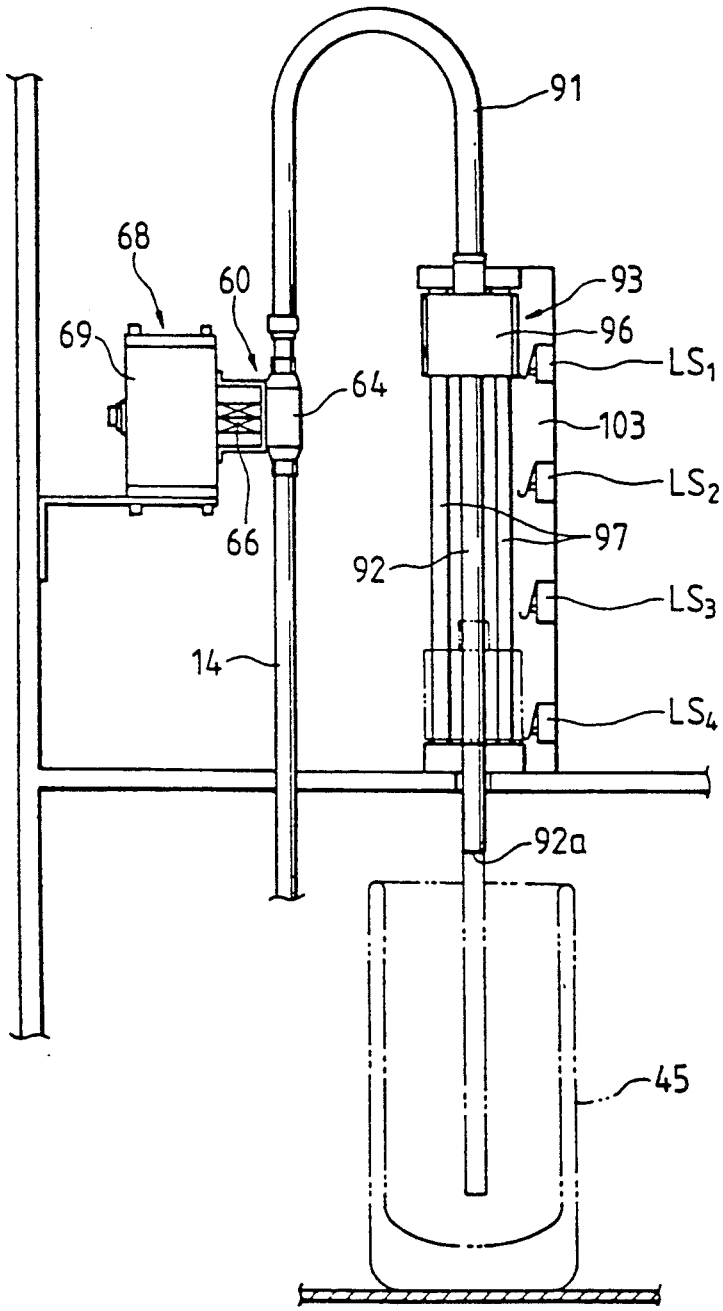
FIG. 25 is a basic structural view showing an eighth embodiment of a draught beer dispensing system according to the present invention.

Next, a seventh embodiment of a draught beer dispensing system according to the present invention will be described with reference to FIG. 24.

A dispensing nozzle 92 in the present embodiment is composed of a double pipe comprising an inner pipe 92A constituting a fixed pipe and an outer pipe 92B constituting a movable pipe, the inner pipe 92A having its upper end directly connected to a beer dispensing valve 60, the flexible tube 91 not being provided. That is, as shown in FIGS. 24(*a*) and 24(*b*), to the beer dispensing valve 60 is connected a beer supplying pipe 14, a blow gas supplying pipe 99 (not shown) and an inner pipe 92A of the dispensing nozzle 92. The outer pipe 92B is slidably fitted over the inner pipe 92A, the outer pipe 92B being connected to a movable stand 96 of a rodless cylinder 93. Other structures are similar to those of the embodiment shown in FIGS. 16 to 23.

Next, the operation of the draught beer dispensing system constructed as mentioned above will be described with reference to FIGS. 24(*a*) and 24(*c*). The controlling electric circuit is exactly the same as one shown in FIG. 22.

Referring to FIG. 22, when the nozzle elevating button $PB_1$ is depressed, the relay $X_1$ is turned ON, the auxiliary contacts $X_{1-1}$ and $X_{1-2}$ of the relay $X_1$ are closed, and the electromagnetic valve $SV_8$ is turned ON to effect flowpassage switching, the relay $X_1$ being self-retained. In FIG. 16, the carbon dioxide gases flows into the port P of the electromagnetic valve $SV_8$ from the carbon dioxide gas supplying pipe 10B and thence pass through the port B from the port P into the upper chamber 98U of the rodless cylinder 93. On the other hand, gases within the lower chamber 93D is released to atmosphere, and the piston 95 is slidably moved downward, whereby the movable stand 96 and the outer pipe 92B of the dispensing nozzle 92 connected thereto are moved downward, and the front end 92*a* of the outer pipe 92B is positioned within the receptacle 45 as shown in FIG. 24(*a*).

Subsequently, when the liquid-out button $PB_3$ is depressed, the draught beer is dispensed into the receptacle 45 in a manner similar to the aforementioned embodiment.

Upon completion of dispensing draught beer, the time auxiliary contact $X_{3-2}$ of the relay $X_3$ is opened, the relay $X_1$ is turned OFF, the auxiliary contacts $X_{1-1}$ and $X_{1-2}$ of the relay $X_1$ are opened, the self-retaining of the relay $X_1$ being released, and the electromagnetic valve $SV_8$ is turned OFF. Thereby, the carbon dioxide gases pass through the port A from the port P of the electromagnetic valve $SV_8$ and flow into the lower chamber 93D of the rodless cylinder 93 whereas the carbon dioxide gases within the upper chamber 93U is released into atmosphere, the piston 95 is slidably moved upward, the movable stand 96 and the outer pipe 92B of the dispensing nozzle 92 is moved upward, and the front end 92*a* of the outer pipe 92B is positioned upwardly of the upper edge 45*a* of the receptacle 46 as shown in FIG. 24(*c*).

The blowing step of the residual draught beer within the dispensing nozzle 92 is carried out exactly in the same manner as that of the aforementioned embodiment. In the present embodiment, since the length from the beer dispensing valve 60 to the tip 92*a* of the dispensing nozzle 92 can be made to be shorter than that of the sixth embodiment, the quantity of residual beer to be blown can be made to be smaller than that of the sixth embodiment.

While in two embodiments shown in FIGS. 16 to 24, only the dispensing nozzle 92 is moved up and down, it is to be noted that the dispensing nozzle 92 and the beer dispensing valve 60 may be integrally moved up and down. In this case, the dispensing nozzle 92 is directly connected to the beer dispensing valve 60, the dispensing nozzle 92 being in the form of a single pipe, and the movable stand 96 of the rodless cylinder 93 is connected to the beer dispensing valve 60. A flexible tube is interposed between the beer dispensing valve 60 and the beer supplying pipe 14.

While in the above-described embodiments, a rodless cylinder whose driving force comprises a carbon dioxide gas pressure or an air pressure has been used to move the nozzle 92 upward and downward, it is to be noted that a simple mechanism may be employed, which mechanism uses a constant load spring or the like and requires no power source.

Next, an eighth embodiment of a draught beer dispensing system according to the present invention will be described with reference to FIGS. 25 to 28.

In the present invention, an intermediate stopping mechanism of a dispensing nozzle is provided in the embodiment shown in FIG. 17. That is, a flexible tube 91 is connected to a beer dispensing valve 60, the flexible tube 91 having a dispensing nozzle 92 connected thereto. The dispensing nozzle 92 has its upper end connected to a movable stand 96 of a rodless cylinder 93. A bracket 103 is provided adjacent to one guide bar 97, the bracket 103 having four limit switches $LS_1$, $LS_2$, $LS_3$ and $LS_4$ secured thereto. These limit switches are turned ON when they comes into contact with the lower end of the vertically moving movable stand 96, whereby the limit switch $LS_1$ detects an upper limit position of the dispensing nozzle 92, the limit switches $LS_2$ and $LS_3$ detect an intermediate position of the dispensing nozzle 92, and the limit switch $LS_4$ detects a lower limit position of the dispensing nozzle 92.

The rodless cylinder 93 is connected to an electromagnetic valve $SV_{11}$ through connection pipes 98*a* and 98*b*, the electromagnetic valve $SV_{11}$ being connected to a carbon dioxide gas cylinder 13 via a pressure reducing valve 12B through a carbon dioxide supplying pipe 10B. The electromagnetic valve $SV_{11}$ comprises a 5-port double solenoid valve, which has switching positions at three positions having a neutral position in the midst thereof. When the solenoid valve $SV_{11-1}$ is ON and a solenoid valve $SV_{11-2}$ OFF, the movable stand 96 of the rodless cylinder 93 is moved downward; when the solenoid valve $SV_{11-1}$ is OFF and the solenoid valve $SV_{11-2}$ is ON, the movable stand 96 is moved upward; and when the solenoid valve $SV_{11-1}$ and $SV_{11-2}$ is OFF, the movable stand 96 stops.

Next, the operation of the eighth embodiment of the draught beer dispensing system constructed as mentioned above will be described with reference to FIGS. 27 and 28.

Figure 27:
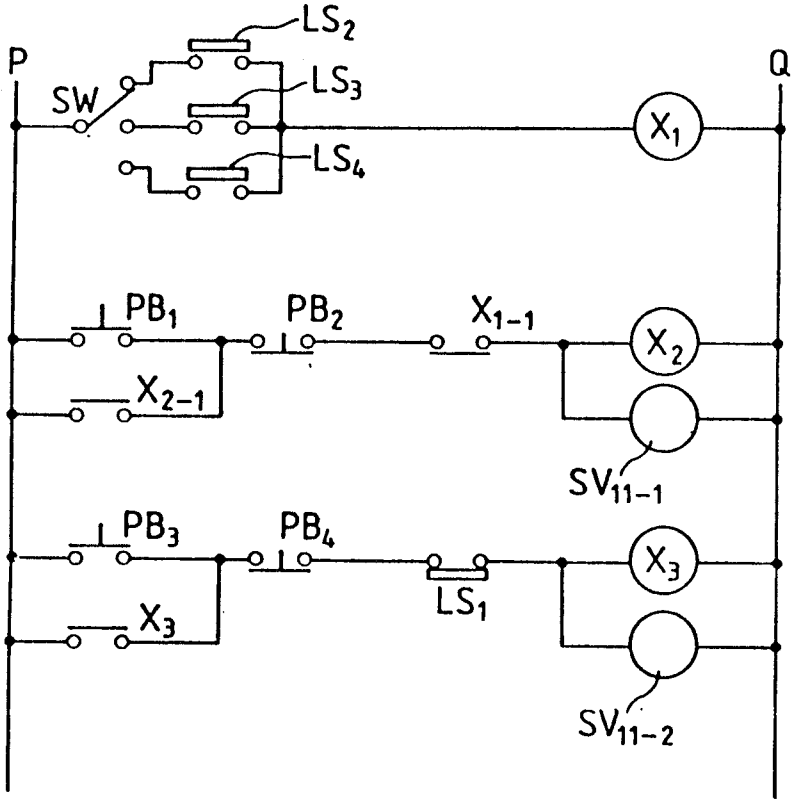
FIG. 27 shows a controlling electric circuit in the eighth embodiment.

In FIG. 27, a nozzle height selection switch SW for selecting the height of a nozzle is operated to select a nozzle height position. In this example, a description will be made of the case where a nozzle height position is selected to an L position.

Figure 26:
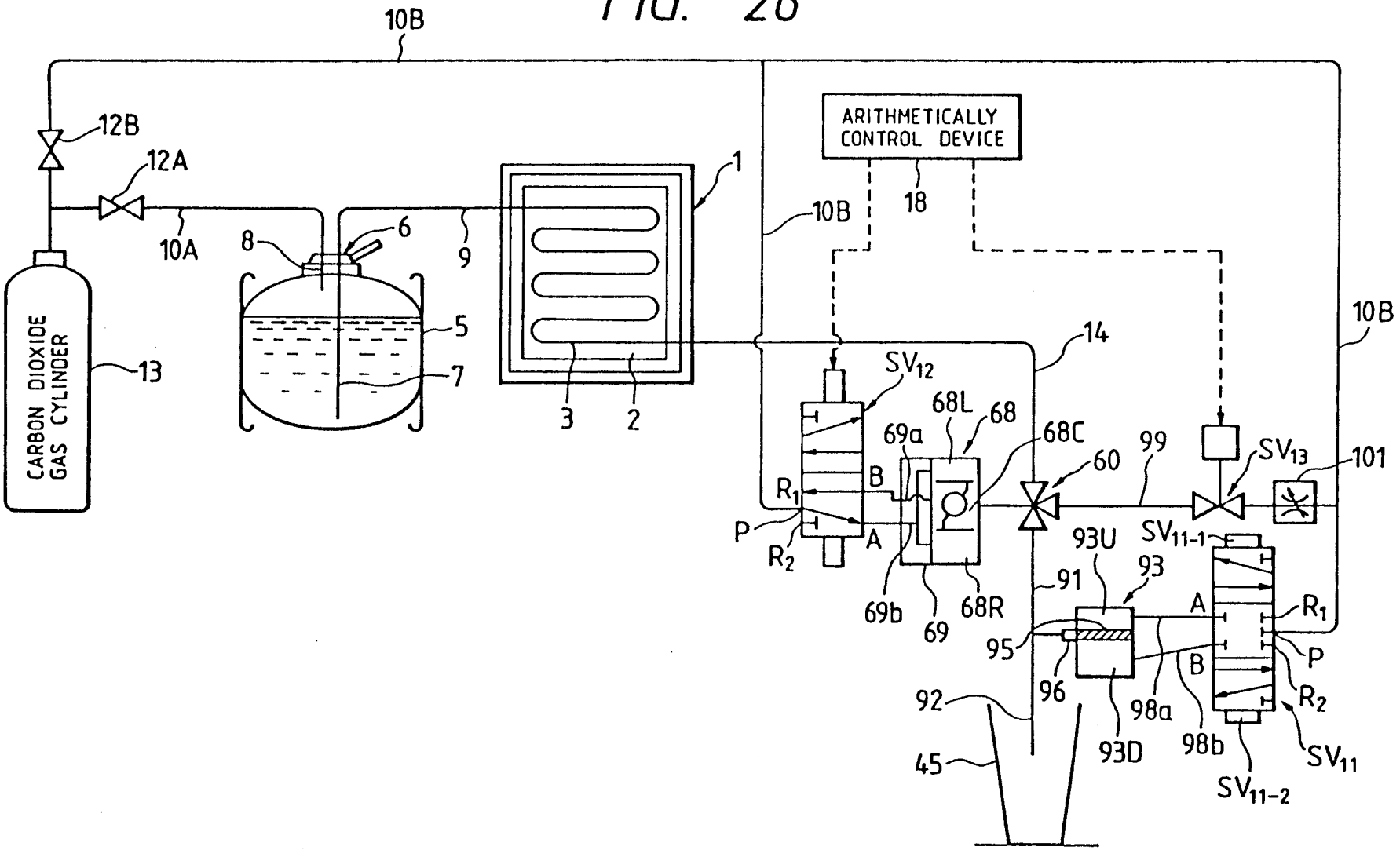
FIG. 26 shows a piping system.
Figure 29:
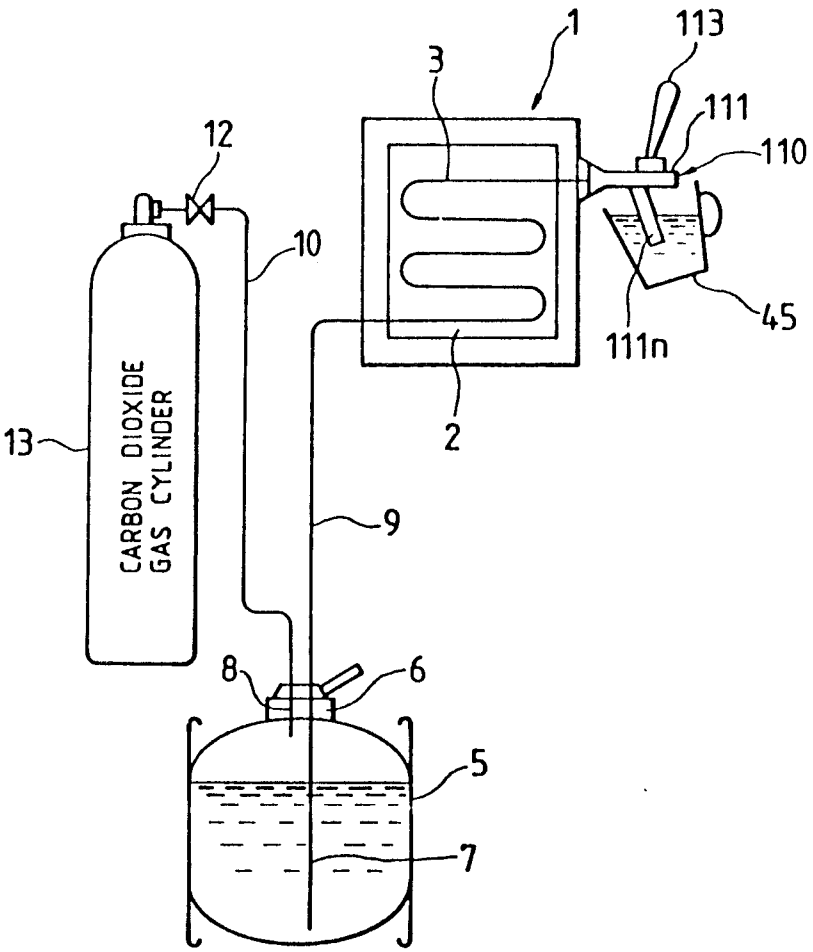
FIG. 29 is a basic structural view of a conventional draught beer dispensing system.

Then, when a nozzle down button $PB_1$ is depressed, a relay $X_2$ is turned ON, an auxiliary contact $X_{2-1}$ of the relay $X_2$ is closed, and the solenoid valve $SV_{11-1}$ of the electromagnetic valve $SV_{11}$ is turned ON to effect flow-passage passage switching, the relay $X_2$ being self-retained. In FIG. 26, the carbon dioxide gases flows into the port P of the electromagnetic valve $SV_{11}$ from the carbon dioxide gas supplying pipe 10B and thence pass through the port A from the port P into the upper chamber 93U of the rodless cylinder 93. On the other hand, the carbon dioxide gases within the lower chamber 93D are released into atmosphere, and the piston is slidably moved downward whereby the movable stand 96 and the dispensing nozzle 92 connected thereto are moved downward.

Figure 28C:
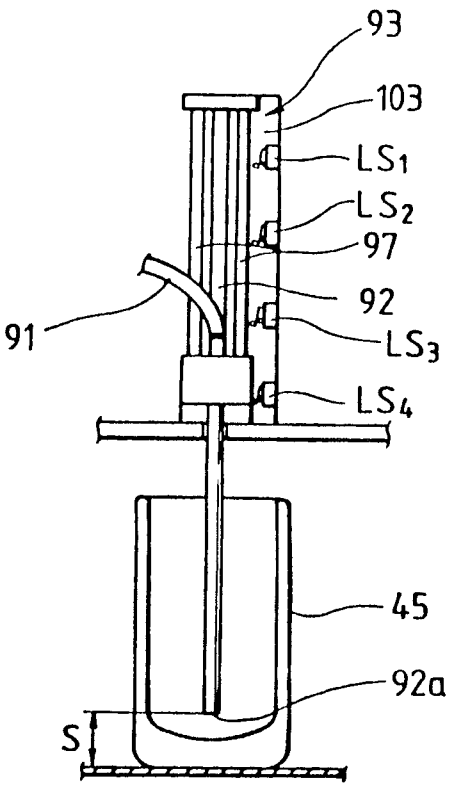
FIG. 28 is an explanatory view of operation of the eighth embodiment.
Figure 28B:
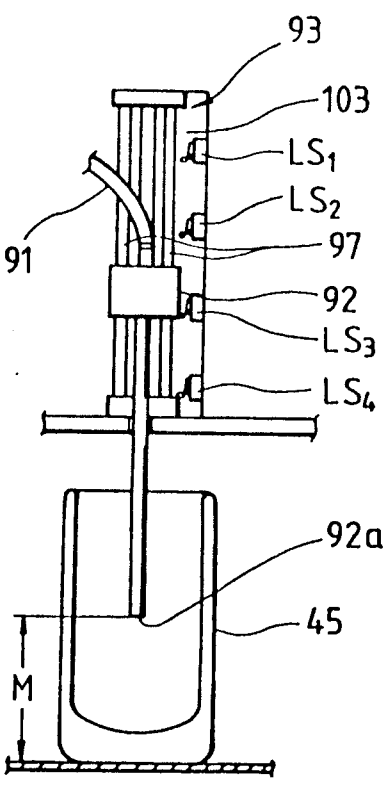
Figure 28A:
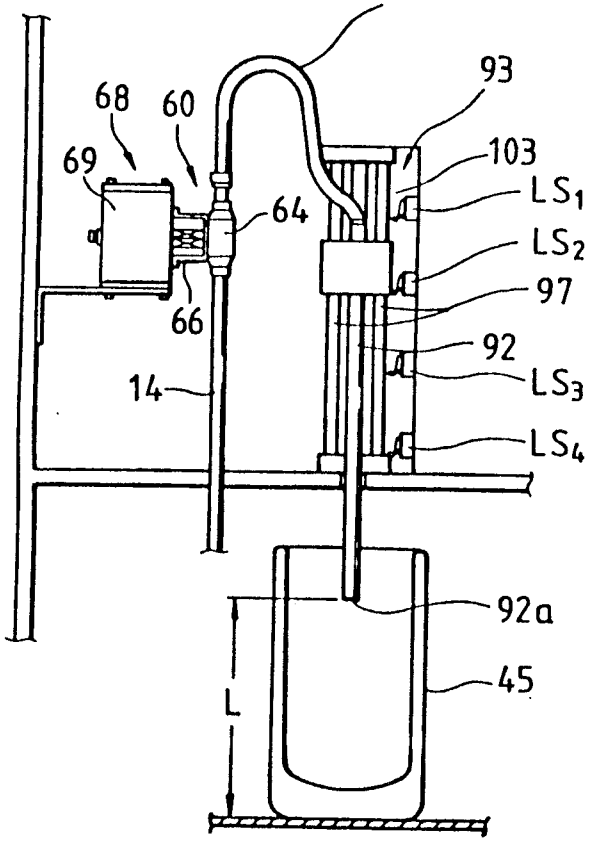
Figure 30:
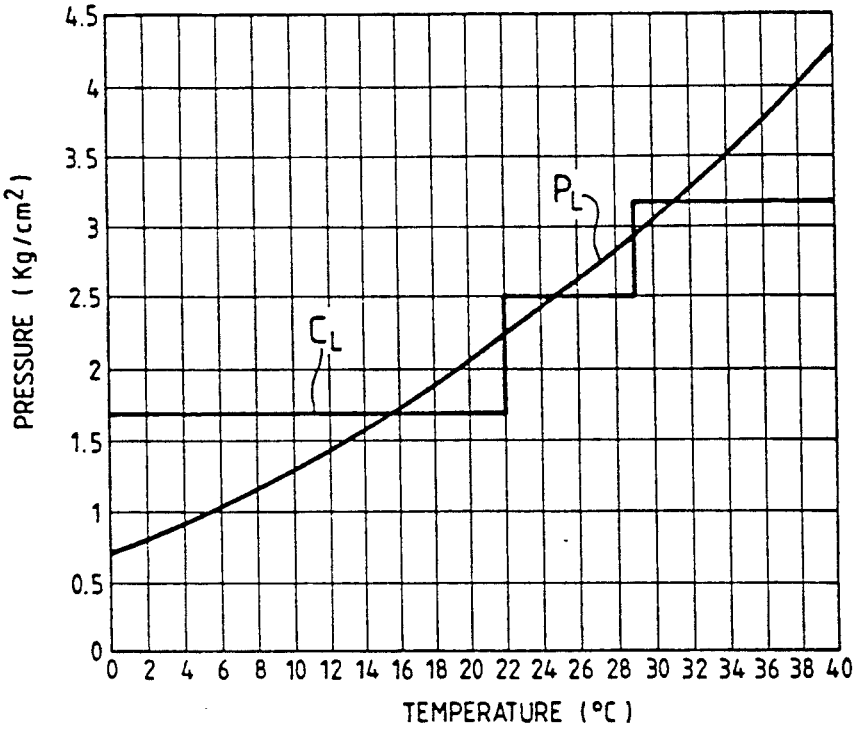
FIG. 30 is a view showing the relationship between a beer temperature and pressure of a conventional system.
Figure 31:
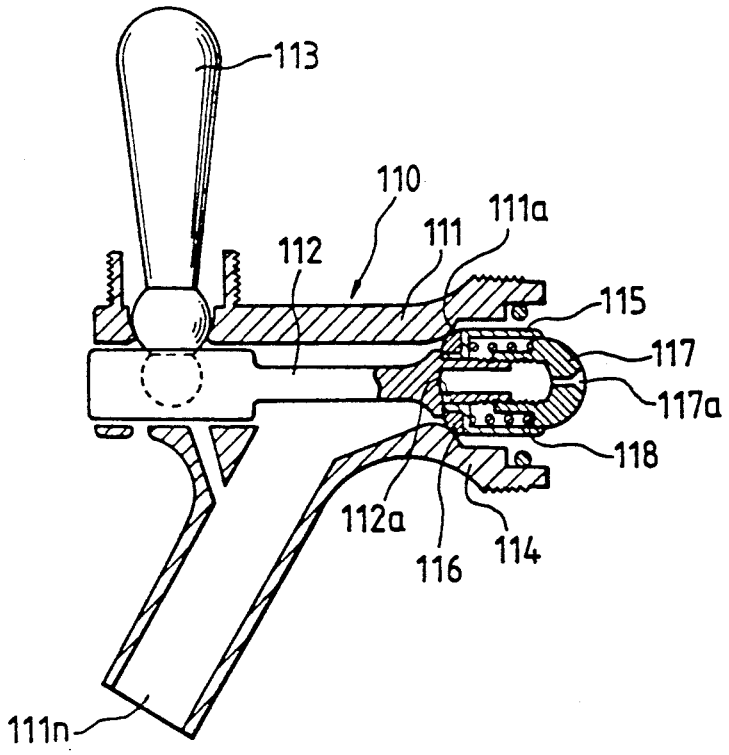
FIG. 31 is a sectional view of a beer dispensing valve of a conventional draught beer dispensing system.
Figure 32B:
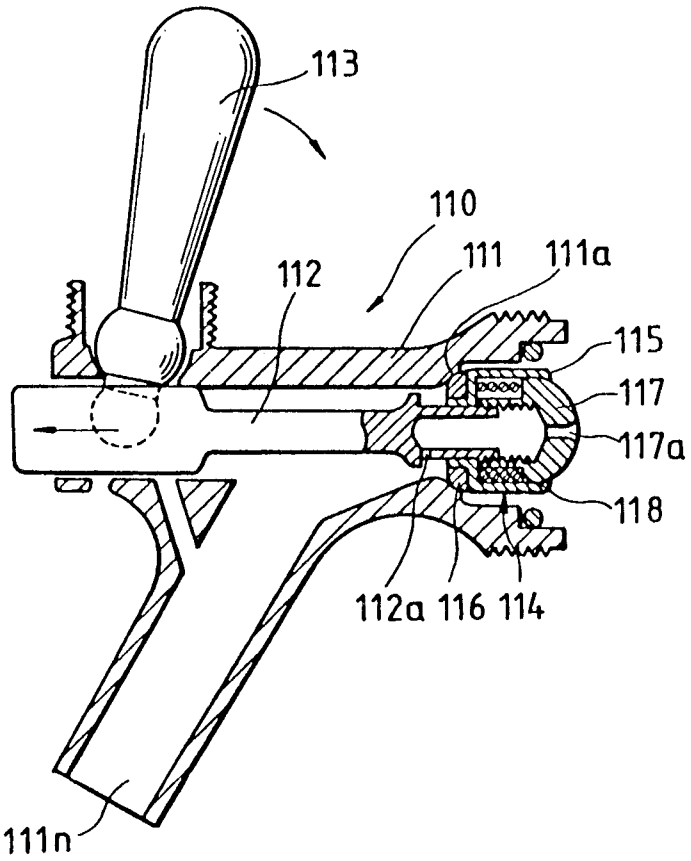
FIG. 32 is an explanatory view of operation of the beer dispensing valve.
Figure 32A:
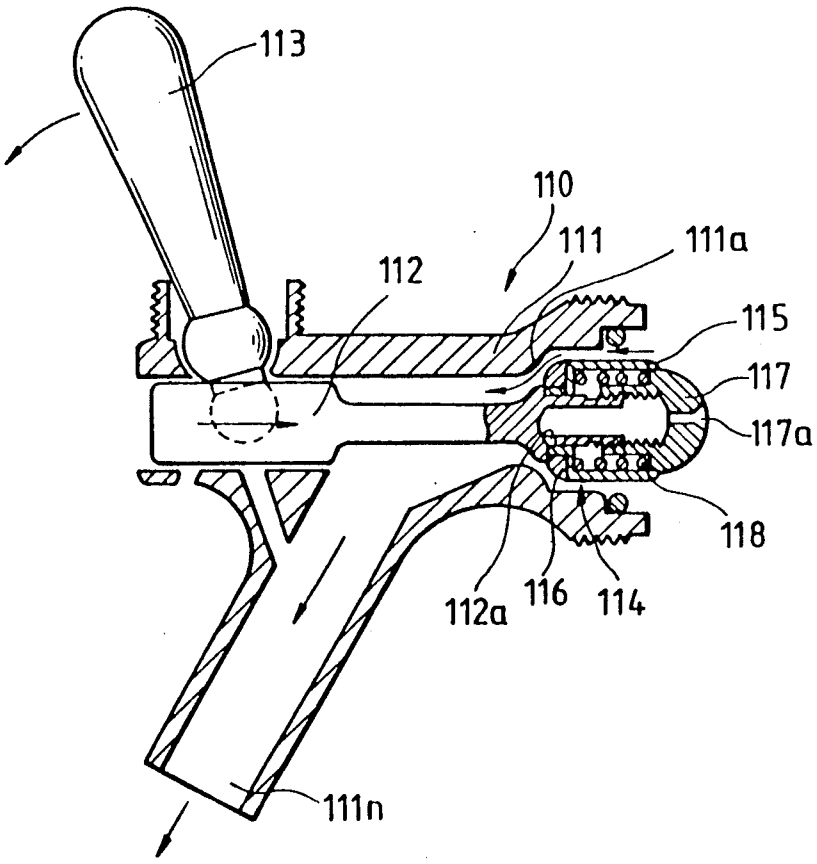

When the movable stand 96 knocks the limit switch $LS_2$, the relay $X_1$ is turned ON and the auxiliary contact $X_{1-1}$ is opened whereby the self-retaining of the relay $X_2$ is released, the solenoid $SV_{11-1}$ of the electromagnetic valve $SV_{11}$ is turned OFF, and ports A and B of the electromagnetic valve $SV_{11}$ are closed (which is the state shown in FIG. 26). That is, the intake to the rodless cylinder 93 and exhaust therefrom are simultaneously stopped, and therefore the movable stand 96 stops and the dispensing nozzle 92 stops at an intermediate position which is an L position at which the tip 92*a* of the nozzle 92 is slightly inserted into the receptacle 45 as shown in FIG. 28(*a*). When dispensing of beer is terminated at said intermediate position and when the nozzle up button $PB_3$ turned ON, the relay $X_3$ is turned ON, the auxiliary contact $X_{3-1}$ of the relay $X_3$ is closed, and the solenoid $SV_{11-2}$ of the electromagnetic valve $SV_{11}$ is turned ON to effect flow-passage switching, the relay $X_3$ being self-retained In FIG. 26, the carbon dioxide gases flow into the port P of the electromagnetic valve $SV_{11}$ from the carbon dioxide supplying pipe 10B, and thence pass through the port B from the port P into the lower chamber 93D of the rodless cylinder 93. The carbon dioxide gases within the upper chamber 93U are released into atmosphere, the piston 95 is slidably moved upward whereby the movable stand 96 and the dispensing nozzle 92 connected thereto are moved upward. When the movable stand 96 knocks the limit switch $LS_1$, the self-retaining of the relay $X_3$ is released, the solenoid $SV_{11-2}$ of the electromagnetic valve $SV_{11}$ is turned OFF, and the dispensing nozzle 92 stops at the upper limit position.

If the nozzle height selection switch SW selects a position M, the tip 92*a* of the dispensing nozzle 92 stops at an intermediate position which is the position M at which the tip 92*a* is inserted into an approximately central portion within the receptacle 45 as shown in FIG. 28(*b*). Further, if the nozzle height selection switch SW selects a position S, the tip 92*a* of the dispensing nozzle 92 stops at he lower limit position of the position S at which the tip 92*a* is inserted in the vicinity of the bottom within the receptacle 45 as shown in FIG. 28(*c*).

As will be apparent from the aforementioned description, according to the present invention, the nozzle height position when beer is dispensed can be variously changed. Therefore, the foaming amount is sometimes different depending on the properties (the content of carbon dioxide gases and temperature) of beer when beer is dispensed. However, by changing the nozzle height position as described above, surplus foaming of beer can be avoided to always provide an optimum foaming amount.

While in the present embodiment, the dispensing nozzle is moved upward and downward and a plurality of stop positions are provided, it is to be noted that a receptacle placing table is made to be moved upward and downward by an air cylinder, and a plurality of stop positions may be provided to obtain exactly the same functions and effects as those of the former.

What is claimed is:

1. A draught beer dispensing system for dispensing draught beer within a draught beer receiving receptacle except a sealed receptacle comprising:

a beer dispensing valve means, operated by carbon dioxide gas, from which the draught beer is dispensed under the pressure of the carbon dioxide gas;

a source of supplying the carbon dioxide gas, said gas supplying source being disposed in the draught beer dispensing system;

a dispensing nozzle communicated with and connected to said beer dispensing valve means;

said beer dispensing valve means including an automatic ball valve comprising a ball having a through hole and a beer dispensing valve actuating means, operated by the carbon dioxide gas, comprising a joint connected to the ball and an opening and closing cylinder for rotating the ball by 90°, said opening and closing cylinder comprising an outer tube, a pair of pistons slidably fitted within the outer tube and operated by the carbon dioxide gas, a rotational shaft rotatably supported on the outer tube and capable of being rotated by the pistons for rotating the joint; and said dispensing nozzle being operated by the carbon dioxide gas from said source having a double pipe structure comprising a fixed pipe secured to said beer dispensing valve means and a movable pipe which is movable with respect to said fixed pipe, whereby a relative position between a tip of the movable pipe and the receptacle is changed so that when draught beer is dispensed the tip of said movable pipe is positioned within the receptacle, and upon termination of dispensing, the tip of the movable pipe is moved upwardly of the upper edge of the receptacle.

* * * * *